US006414447B1

(12) United States Patent
Kitamura et al.

(10) Patent No.: US 6,414,447 B1
(45) Date of Patent: Jul. 2, 2002

(54) DISCHARGE LAMP LIGHTING DEVICE AND ILLUMINATING DEVICE

(75) Inventors: Noriyuki Kitamura, Hadano; Tsutomu Kakitani, Yokohama; Fuminori Nakaya, Miura, all of (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 0 days.

(21) Appl. No.: 09/719,827

(22) PCT Filed: Mar. 31, 2000

(86) PCT No.: PCT/JP00/02092

§ 371 (c)(1),
(2), (4) Date: Mar. 1, 2001

(87) PCT Pub. No.: WO00/64222

PCT Pub. Date: Oct. 26, 2000

(30) Foreign Application Priority Data

Apr. 16, 1999 (JP) ..... 11-110105

(51) Int. Cl.[7] ..... H05B 41/16

(52) U.S. Cl. ..... 315/272; 315/206; 315/219; 315/227 R; 315/276; 315/283

(58) Field of Search ..... 315/200 R, 206, 315/207, 209 R, 219, 223, 209 T, 227 R, 244, 246, 272, 276, 283, 291, 307, DIG. 2, DIG. 5, DIG. 7

(56) References Cited

U.S. PATENT DOCUMENTS 4,415,838 A * 11/1983 Houkes ..... 315/276
5,517,086 A * 5/1996 El-Hamamsy et al. ..... 315/247
5,777,861 A 7/1998 Shimizu et al. ..... 363/37

FOREIGN PATENT DOCUMENTS

| | | |
|---|---|---|
| CN | 1122966 | 5/1996 |
| DE | 19813187 | 10/1998 |
| EP | 0680246 | 11/1995 |
| EP | 0926928 | 6/1999 |
| JP | 07-274536 | 10/1995 |
| JP | 08-098555 | 4/1996 |
| JP | 10-285946 | 10/1998 |
| JP | 10-294193 | 11/1998 |
| WO | 98/47323 | 10/1998 |

* cited by examiner

*Primary Examiner*—Don Wong
*Assistant Examiner*—Thuy Vinh Tran
(74) *Attorney, Agent, or Firm*—Darby & Darby

(57) ABSTRACT

A combination-type high frequency inverter connects an isolation leakage transformer, a smoothing condenser, a resonance condenser, a first field-effect transistor and a second field-effect transistor to a diode bridge and rectifies the voltage of an AC power source in a non-smoothing rectification manner. A load circuit has a secondary winding of an isolation leakage transformer, a fluorescent lamp and a condenser. The 'on' duration of the first field-effect transistor is variable. The duration of on-duty of the second field-effect transistor is fixed. Adjusting charge voltage on the smoothing condenser changes the high frequency output voltage and the load characteristics. Load characteristics, optimal for the current mode, are given to the fluorescent lamp, in accordance with whether the flourescent lamp is in either start-up or luminance mode. Since the 'on' duration of the first-field effect transistor is variable, output compensation for fluxuation in source voltage is easily conducted.

17 Claims, 14 Drawing Sheets

DISCHARGE LAMP LIGHTING DEVICE AND ILLUMINATING DEVICE

TECHNICAL FIELD

The present invention relates to a discharge lamp lighting device and a lighting system.

BACKGROUND OF THE INVENTION

Generally speaking, when a discharge lamp is close to the end of its life, it causes a half-wave discharge, which is an abnormal discharge that generates abnormal heat in the regions around the electrodes. This causes a particularly serious problem in case of a discharge lamp having a slender glass bulb. As the distance between the glass bulb of a slender-type lamp and each one of the electrodes that are contained in the glass bulb is minimal, such an abnormal discharge tends to increase the temperature of the glass bulb excessively, sometimes resulting in melting of the glass bulb, the plastic bases attached to the glass bulb, and the sockets on which the plastic bases are mounted.

Melting of this type may be prevented by various means; for example, when an abnormality such as reaching the end of life, is detected in a discharge lamp the function of a high frequency generating means that serves to light the discharge lamp may be halted.

However, stopping the function of the high frequency generating means causes the discharge lamp to become dark.

An example of conventionally known structure that are capable of preventing a discharge lamp from becoming dark when an abnormality is detected is disclosed in Japanese Patent Provisional Publication No. 231295-1989. The discharge lamp lighting device disclosed in said Japanese Patent Provisional Publication No. 231295-1989 calls for connecting a plurality of discharge lamps in parallel with one another and, upon detecting an abnormality such as coming to the end of life in one or more discharge lamps when said plurality of discharge lamps are lit, reducing the output from the high frequency generating means to such a level that the other lamps, which are operating in normal conditions, can remain lit. In other words, if there is any discharge lamp that has reached the end of its life, the other discharge lamps are kept lit in the state where the output from the high frequency generating means is reduced. Thus, the minimum necessary luminance level is ensured.

However, should the discharge lamp lighting device disclosed in Japanese Patent Provisional Publication No. 231295-1989 be applied to slender-type discharge lamps, wherein the distance between the glass bulb and each electrode of each lamp is minimal, the temperature of the glass bulb of an abnormal lamp would be still too high in spite of the reduced output from the high frequency generating means.

Furthermore, the structure described above calls for reducing the output to such a level as to prevent the discharge lamps in the abnormal condition from continuing the discharge. Doing thus, however, makes it difficult to keep the normal discharge lamps lit. In case there is an abnormal lamp in a household lighting fixture, which is normally designed such that a single high frequency generating means lights two or more discharge lamps having different rated power, it is particularly difficult to keep the other discharge lamps, which are in the normal conditions, lit.

In order to solve the above problems, an object of the present invention is to provide a discharge lamp lighting device and a lighting system that are capable of lighting discharge lamps in an appropriate condition and maintaining them so they are appropriately lit.

DISCLOSURE OF THE INVENTION

The invention includes a load circuit having a discharge lamp, an inductance and a capacitance; and a combination-type high frequency inverter having a full-wave rectifier for rectifying a low frequency AC voltage without smoothing the voltage, an inductor, a smoothing condenser, a resonance condenser and at least a pair of switching means which have a function of an antiparallel diode and are adapted to be alternately switched and respectively take part in charging the smoothing condenser and discharge from the smoothing condenser, said combination-type high frequency inverter adapted to operate in such a manner that the 'on' duration of the switching means that is adapted to take part in charging the smoothing condenser is variable, while the 'on' duration of the switching means that is adapted to take part in discharge from the smoothing condenser is fixed, and the combination-type high frequency inverter having a function of an active filter and serving to energize the load circuit with a high frequency output.

By operating the combination-type high frequency inverter with the 'on' duration of the switching means that is adapted to take part in charging the smoothing condenser being variable and the 'on' duration of the switching means that is adapted to take part in discharge from the smoothing condenser being fixed, the charge voltage on the smoothing condenser can be adjusted so that the high frequency output voltage and, consequently, the load characteristics are changed as desired. The invention described above is thus capable of easily giving a discharge lamp load characteristics that are optimal for the current mode in accordance with whether the discharge lamp is in the start-up mode or luminance mode. Furthermore, by making the 'on' duration of the switching means that is adapted to take part in charging the smoothing condenser variable, output compensation for fluctuation in the source voltage can easily be conducted.

According to another feature thereof, the invention includes a load circuit having a discharge lamp, an inductance and a capacitance; and a combination-type high frequency inverter having a full-wave rectifier for rectifying a low frequency AC voltage without smoothing the voltage, a series circuit consisting of an inductor and a first switching means that is connected to a point between DC output terminals of said full-wave rectifier and has a function of an antiparallel diode, a series circuit consisting of a smoothing condenser, said first switching means, which is connected to a point between the DC output terminals of the full-wave rectifier, and a second switching means which has a function of an antiparallel diode and is adapted to be switched alternately with the first switching means, and a resonance condenser adapted to generate high frequency resonance with the inductor, said combination-type high frequency inverter adapted to operate in such a manner that the 'on' duration of the first switching means is variable, while the 'on' duration of the second switching means is fixed, and the combination-type high frequency inverter having a function of an active filter and serving to energize the load circuit with a high frequency output.

By operating the combination-type high frequency inverter that has a function of an active filter of a polarity reversing type with the 'on' duration of the switching means that is adapted to take part in charging the smoothing condenser being variable and the 'on' duration of the switching means that is adapted to take part in discharge from the smoothing condenser being fixed, the charge voltage on the smoothing condenser can be adjusted so that the high frequency output voltage and, consequently, the load characteristics are changed as desired. The invention described above is thus capable of easily giving a discharge lamp load characteristics that are optimal for the current mode in accordance with whether the discharge lamp is in the start-up mode or luminance mode. Furthermore, by making the 'on' duration of the switching means that is adapted to take part in charging the smoothing condenser variable, output compensation for fluctuation in the source voltage can easily be conducted.

According to yet another feature thereof, the invention includes a load circuit having a discharge lamp, an inductance and a capacitance; and a combination-type high frequency inverter having a full-wave rectifier for rectifying a low frequency AC voltage without smoothing the voltage, a series circuit consisting of a first switching means and a second switching means that are connected to a point between DC output terminals of said full-wave rectifier and are adapted to be alternately switched so as to have a function of an antiparallel diode, a series circuit consisting of an inductor and a smoothing condenser, said inductor connected in parallel with the second switching means, and a resonance condenser adapted to generate high frequency resonance with the inductor, said combination-type high frequency inverter adapted to operate in such a manner that the 'on' duration of the first switching means is variable, while the 'on' duration of the second switching means is fixed, and the combination-type high frequency inverter having a function of an active filter and serving to energize the load circuit with a high frequency output.

By operating the combination-type high frequency inverter that has a function of an active filter of a voltage reducing type with the 'on' duration of the switching means that is adapted to take part in charging the smoothing condenser being variable and the 'on' duration of the switching means that is adapted to take part in discharge from the smoothing condenser being fixed, the charge voltage on the smoothing condenser can be adjusted so that the high frequency output voltage and, consequently, the load characteristics are changed as desired. The invention described above is thus capable of easily giving a discharge lamp load characteristics that are optimal for the current mode in accordance with whether the discharge lamp is in the start-up mode or luminance mode. Furthermore, by making the 'on' duration of the switching means that is adapted to take part in charging the smoothing condenser variable, output compensation for fluctuation in the source voltage can easily be conducted.

According to yet another feature thereof, the invention includes a load circuit having a discharge lamp, an inductance and a capacitance; and a combination-type high frequency inverter having a full-wave rectifier for rectifying a low frequency AC voltage without smoothing the voltage, a series circuit consisting of an inductor that is connected to a point between DC output terminals of said full-wave rectifier and a first switching means having a function of an antiparallel diode, a series circuit consisting of a smoothing condenser and a second switching means which has a function of an antiparallel diode connected in parallel with the first switching means and is adapted to be switched alternately with the first switching means, and a resonance condenser adapted to generate high frequency resonance with the inductor, said combination-type high frequency inverter adapted to operate in such a manner that the 'on' duration of the first switching means is variable, while the 'on' duration of the second switching means is fixed, and the combination-type high frequency inverter having a function of an active filter and serving to energize the load circuit with a high frequency output.

By operating the combination-type high frequency inverter that has a function of an active filter of a boosting type with the 'on' duration of the switching means that is adapted to take part in charging the smoothing condenser being variable and the 'on' duration of the switching means that is adapted to take part in discharge from the smoothing condenser being fixed, the charge voltage on the smoothing condenser can be adjusted so that the high frequency output voltage and, consequently, the load characteristics are changed as desired. The invention described above is thus capable of easily giving a discharge lamp load characteristics that are optimal for the current mode in accordance with whether the discharge lamp is in the start-up mode or luminance mode. Furthermore, by making the 'on' duration of the switching means that is adapted to take part in charging the smoothing condenser variable, output compensation for fluctuation in the source voltage can easily be conducted.

According to yet another feature thereof, the invention includes a load circuit provided with a discharge lamp, an inductance and a capacitance and having an natural resonance frequency; and a combination-type high frequency inverter having a full-wave rectifier for rectifying a low frequency AC voltage without smoothing the voltage, at least a pair of switching means which have a function of an antiparallel diode and are adapted to be alternately switched, an inductor, a smoothing condenser, and a resonance condenser, said combination-type high frequency inverter adapted to operate with the duration of the 'on' state of one of the switching means variable and the 'on' duration of the other switching means fixed at a length of time where the range is 1 to 1.5 times the natural resonance cycle of the load circuit, and the combination-type high frequency inverter having a function of an active filter and serving to energize the load circuit with a high frequency output.

With the configuration as above, lagging switching is conducted with the combination-type high frequency inverter with the 'on' duration of one of the switching means fixed at a length of time where the range is 1 to 1.5 times the natural resonance cycle of the load circuit, there by preventing occurrence of phase advancing switching, which may otherwise exert an unfavorable influence on the switching means. By making the 'on' duration of the other switching means variable, the charge voltage on the smoothing condenser can be adjusted so that the high frequency output voltage and, consequently, the load characteristics are changed as desired. The configuration described above is thus capable of easily giving a discharge lamp load characteristics that are optimal for the current mode in accordance with whether the discharge lamp is in the start-up mode or luminance mode.

According to yet another feature thereof, the invention includes a load circuit provided with a discharge lamp, an inductance and a capacitance and having an natural resonance frequency; and a combination-type high frequency inverter having a full-wave rectifier for rectifying a low frequency AC voltage without smoothing the voltage, a series circuit consisting of an inductor and a first switching means that is connected to a point between DC output terminals of said full-wave rectifier and has a function of an antiparallel diode, a series circuit consisting of a smoothing condenser, said first switching means, which is connected to a point between the DC output terminals of the full-wave rectifier, and a second switching means which has a function of an antiparallel diode and is adapted to be switched alternately with the first switching means, and a resonance condenser adapted to generate high frequency resonance with the inductor, said combination-type high frequency inverter adapted to operate with the duration of the 'on' state of either the first switching means or the second switching means variable and the 'on' duration of the other switching means fixed at a length of time where the range is 1 to 1.5 times the natural resonance cycle of the load circuit, and the combination-type high frequency inverter having a function of an active filter and serving to energize the load circuit with a high frequency output.

With the configuration as above, lagging switching is conducted with the 'on' duration of one of the switching means of the combination-type high frequency inverter that has a function of an active filter of a polarity reversing type fixed at a length of time where the range is 1 to 1.5 times the natural resonance cycle of the load circuit, thereby preventing occurrence of phase advancing switching, which may otherwise exert an unfavorable influence on the switching means. By making the 'on' duration of the other switching means variable, the charge voltage on the smoothing condenser can be adjusted so that the high frequency output voltage and, consequently, the load characteristics are changed as desired. The configuration described above is thus capable of easily giving a discharge lamp load characteristics that are optimal for the current mode in accordance with whether the discharge lamp is in the start-up mode or luminance mode.

According to yet another feature thereof, the invention includes a load circuit provided with a discharge lamp, an inductance and a capacitance and having an natural resonance frequency; and a combination-type high frequency inverter having a full-wave rectifier for rectifying a low frequency AC voltage without smoothing the voltage, a series circuit consisting of a first switching means and a second switching means that are connected to a point between DC output terminals of said full-wave rectifier, have a function of an antiparallel diode and are adapted to be alternately switched, a series circuit consisting of an inductor and a smoothing condenser, said inductor connected in parallel with the second switching means, and a resonance condenser adapted to generate high frequency resonance with the inductor, said combination-type high frequency inverter adapted to operate with the duration of the 'on' state of either the first switching means or the second switching means variable and the 'on' duration of the other switching means fixed at a length of time where the range is 1 to 1.5 times the natural resonance cycle of the load circuit, and the combination-type high frequency inverter having a function of an active filter and serving to energize the load circuit with a high frequency output.

With the configuration as above, lagging switching is conducted with the 'on' duration of one of the switching means of the combination-type high frequency inverter that has a function of an active filter of a voltage reducing type fixed at a length of time where the range is 1 to 1.5 times the natural resonance cycle of the load circuit, thereby preventing occurrence of phase advancing switching, which may otherwise exert an unfavorable influence on the switching means. By making the 'on' duration of the other switching means variable, the charge voltage on the smoothing condenser can be adjusted so that the high frequency output voltage and, consequently, the load characteristics are changed as desired. The configuration described above is thus capable of easily giving a discharge lamp load characteristics that are optimal for the current mode in accordance with whether the discharge lamp is in the start-up mode or luminance mode.

According to yet another feature thereof, the invention includes a load circuit provided with a discharge lamp, an inductance and a capacitance and having an natural resonance frequency; and a combination-type high frequency inverter having a full-wave rectifier for rectifying a low frequency AC voltage without smoothing the voltage, a series circuit consisting of an inductor that is connected to a point between DC output terminals of said full-wave rectifier and a first switching means having a function of an antiparallel diode, a series circuit consisting of a smoothing condenser and a second switching means which has a function of an antiparallel diode connected in parallel with the first switching means and is adapted to be switched alternately with the first switching means, and a resonance condenser adapted to generate high frequency resonance with the inductor, said combination-type high frequency inverter adapted to operate with the duration of the 'on' state of either the first switching means or the second switching means variable and the 'on' duration of the other switching means fixed at a length of time where the range is 1 to 1.5 times the natural resonance cycle of the load circuit, and the combination-type high frequency inverter having a function of an active filter and serving to energize the load circuit with a high frequency output.

With the configuration as above, lagging switching is conducted with the 'on' duration of one of the switching means of the combination-type high frequency inverter that has a function of an active filter of a boosting type fixed at a length of time where the range is 1 to 1.5 times the natural resonance cycle of the load circuit, there by preventing occurrence of phase advancing switching, which may otherwise exert an unfavorable influence on the switching means. By making the 'on' duration of the other switching means variable, the charge voltage on the smoothing condenser can be adjusted so that the high frequency output voltage and, consequently, the load characteristics are changed as desired. The configuration described above is thus capable of easily giving a discharge lamp load characteristics that are optimal for the current mode in accordance with whether the discharge lamp is in the start-up mode or luminance mode.

According to yet another feature of the invention, the operating frequency of the combination-type high frequency inverter is set such that the operating frequency for the period when the discharge lamp is in the start-up mode is close to the natural resonance frequency of the load circuit so as to obtain such load characteristics as a high release voltage and a small amount of short-circuit current and that the operating frequency for the period when the discharge lamp is lit is sufficiently lower than the natural resonance frequency of the load circuit so as to obtain such load characteristics as a low release voltage and a great amount of short-circuit current.

Setting the operating frequency of the combination-type high frequency inverter at a value close to the natural resonance frequency of the load circuit accelerates start up of a discharge lamp, because resonance produces a high release voltage, while the high operating frequency produces a great inductance in the load circuit, resulting in such load characteristics as a small amount of short-circuit current. When the discharge lamp is in the lit state, resonance of the load circuit can be almost entirely prevented by controlling the operating frequency of the combination-type high frequency inverter to a level substantially lower than the natural resonance frequency of the load circuit. As a result, the inductance of the load circuit functions merely as an impedance and reduces the release voltage of the combination-type high frequency inverter, thereby turning off the discharge lamp or reducing its luminance in case the discharge lamp is close to the end of its life.

According to yet another feature thereof, the invention includes a body of a lighting system, and a discharge lamp lighting device supported by said body of the lighting system.

PREFERRED EMBODIMENT OF THE INVENTION

Next, a discharge lamp lighting device according to the first embodiment of the present invention is explained hereunder, referring to the relevant drawings.

Figure 1:
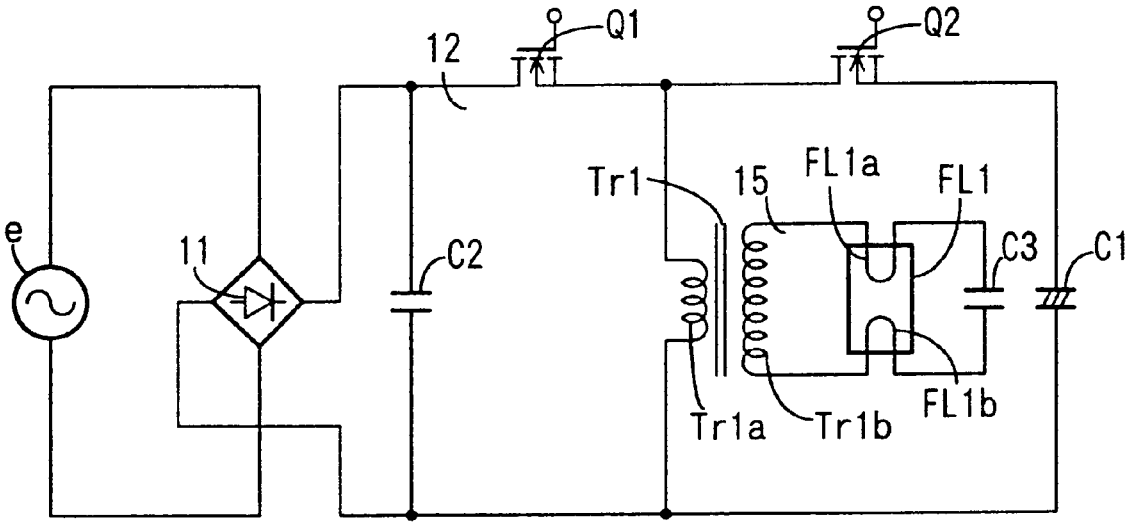
FIG. 1 is a circuit diagram of a first embodiment of a discharge lamp lighting device according to the present invention.
Figure 2:
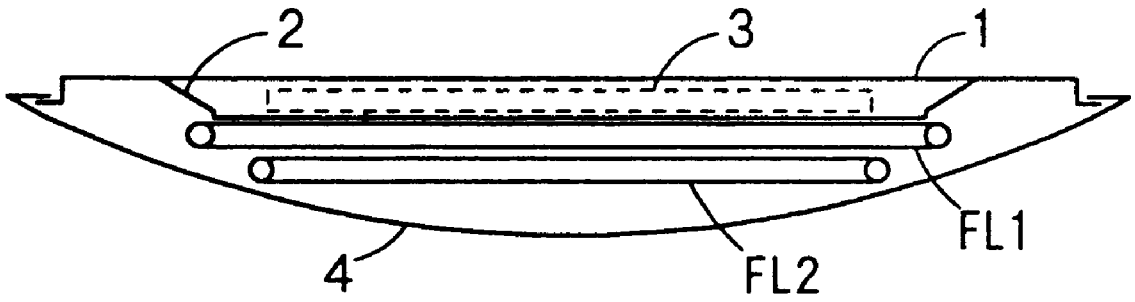
FIG. 2 is a sectional view of a lighting system of a ceiling-mounted type to be directly mounted onto a ceiling.

FIG. 1 is a circuit diagram of the first embodiment of a discharge lamp lighting device according to the present invention, and FIG. 2 is a sectional view of a lighting system of a ceiling-mounted type to be directly mounted onto a ceiling.

Referring to FIG. 2, numeral 1 denotes a shallow, circular dish-shaped chassis 1 that is provided, at the back side thereof, with a mounting means to affix it to a ceiling. A shallow reflection plate 2 is attached to the chassis 1 in such a manner as to face the inner surface of the chassis 1. A discharge lamp lighting device 3 is disposed inside the reflection plate 2, in other words in the space between the chassis 1 and the reflection plate 2.

Circular fluorescent lamps FL1, FL2 serving as discharge lamps are concentrically arranged and disposed so as to face the reflection plate 2. The fluorescent lamps FL1, FL2 are slender-tube type lamps having an outer tube diameter of 16.5 mm and are respectively identified by the product types of FHC27 and FHC34. Both fluorescent lamps FL1, FL2 are designed to perform high-output illumination, at the respective power consumption of 38W and 48W in the full-intensity luminance mode.

A translucent cover 4 is attached to the chassis 1 with a fitting mechanism (not shown) that is provided on the underside of the chassis 1. The translucent cover 4 is disposed over the fluorescent lamps FL1, FL2 and the reflection plate 2 in such a manner as to enclose them. The reflection plate 2 is adapted such that light radiated from the fluorescent lamps FL1, FL2 is reflected on the translucent cover 4 uniformly.

By using circular, fluorescent lamps FL1, FL2 provided with bulbs having an outer diameter of 16.5 mm, the embodiment of the invention enables the reducing of the height or the depth of the lighting system by an average of 40% compared with an ordinary fluorescent lamp of a conventional type, which typically has an outer tube diameter of 29 mm. Therefore, the embodiment provides a lighting fixture which will not look overwhelming even if it is installed in a room having a relatively low ceiling, such as one in a condominium. The lamps of the embodiment have a rated life of 9,000 hours, which is 1.5 times longer than the 6,000 hours of an ordinary fluorescent lamp.

As shown in FIG. 1, the discharge lamp lighting device 3 includes a commercial AC power source e, which is a low frequency AC power supply, and a combination-type-high frequency inverter 12 which is of a polarity reversing, voltage boosting/reducing type connected to the commercial AC power source e. The combination-type high frequency inverter 12 has a function of an inverter for obtaining a high frequency output by using rectified voltage as the power source. Said rectified voltage is obtained by rectifying the voltage of the commercial AC power source e by a diode bridge 11 of the commercial AC power source e in the manner of non-smoothing rectification. The combination-type high frequency inverter 12 has a switching means that principally function as the aforementioned inverter to obtain high-frequency output. However, at least a part of said switching means works with another component of the combination-type high frequency inverter 12 so as to act as an active filter, which is the other function of the combination-type high frequency inverter 12.

The combination-type high frequency inverter 12 includes the aforementioned commercial AC power source e, the diode bridge 11 which is a full-wave rectifier, a first field-effect transistor Q1 serving as a first switching means, a primary winding Tr1*a* of an isolation leakage transformer Tr1 that serves as an inductor, a second field-effect transistor Q2 serving as a second switching means, and a smoothing condenser C1 comprised of an electrolytic capacitor. The AC input terminals of said diode bridge 11 are connected to the commercial AC power source e. The first field-effect transistor Q1 and the primary winding Tr1*a* of the isolation leakage transformer Tr1 form a series circuit that is connected to a point between the non-smoothing DC output terminals of the diode bridge 11. The second field-effect transistor Q2 and the smoothing condenser C1 form a series circuit that is also connected to a point between the non-smoothing DC output terminals of the diode bridge 11 in parallel with the primary winding Tr1*a* of the isolation leakage transformer Tr1. A resonance condenser C2 having a relatively small capacity is connected to the non-smoothing DC output terminals of the diode bridge 11. Although not shown in the drawing, noise filters are disposed in front of the AC input terminal and behind the non-smoothing DC output terminals of the diode bridge 11 so as to prevent high harmonics that are generated by the combination-type high frequency inverter 12 from leaking to the end where the commercial AC power source e is located. The first field-effect transistor Q1 and the second field-effect transistor Q2 are respectively provided with antiparallel parasitic diodes and have the ability to act as equivalent antiparallel diodes. Furthermore, the first field-effect transistor Q1 and the second field-effect transistor Q2 are adapted to be alternately switched by means of a self-excited or separately excited drive circuit (not shown).

A load circuit 15 is connected to the isolation leakage transformer Tr1. The load circuit 15 includes a secondary winding Tr1*b* of the isolation leakage transformer Tr1. The secondary winding Tr1*b* of the isolation leakage transformer Tr1 is disposed between and connected to one end of each respective filament FL1*a*, FL1*b* of the fluorescent lamp FL1, while a condenser C3 which has a relatively small capacity and functions as a capacitance is disposed between and connected to the other ends of the filaments FL1*a*, FL1*b* of the fluorescent lamp FL1. Leakage inductance obtained at the secondary winding Tr1*b* end of the isolation leakage transformer Tr1 is connected equivalently in series with to the fluorescent lamp FL. As leakage inductance of the isolation leakage transformer Tr1 and the condenser C3 i.e. the capacitance, of the load circuit 15 form a series resonance circuit, the load circuit 15 has an natural resonance frequency. In case a plurality of fluorescent lamps are connected, a plurality of load circuits 15 may be arranged in parallel and connected to the secondary winding Tr1*b* end of the isolation leakage transformer Tr1.

Next, the function of the embodiment described above is explained hereunder, referring to Table 1 and FIGS. 3 through 7.

TABLE 1

| | Field-effect Transistor Q1 | Field-effect Transistor Q2 |
|---|---|---|
| I (FIG. 3) | On | Off |
| II (FIG. 4) | Off | On (—) |
| III (FIG. 5) | Off | On |
| IV (FIG. 6) | On (—) | Off |
| V (FIG. 7) | On | Off |

Figure 3:
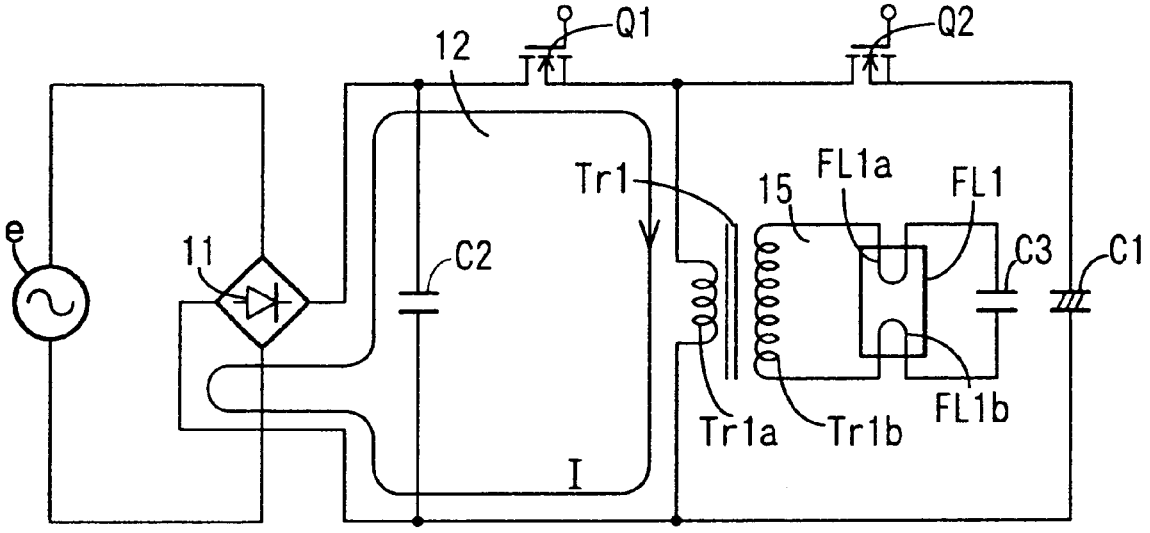
FIG. 3 is a circuit diagram showing the current in a step of the function of said first embodiment.

First, when the first field-effect transistor Q1 is turned on by a starting circuit (not shown), an increase current flows in the closed circuit extending from the positive electrode of the non-smoothing DC output terminals of the diode bridge 11 through the first field-effect transistor Q1 to the primary winding Tr1*a* of the isolation leakage transformer Tr1 and then back to the diode bridge 11 as shown in FIG. 3, with the current value increasing in this order. As a result, electromagnetic energy accumulates in the isolation leakage transformer Tr1.

Figure 4:
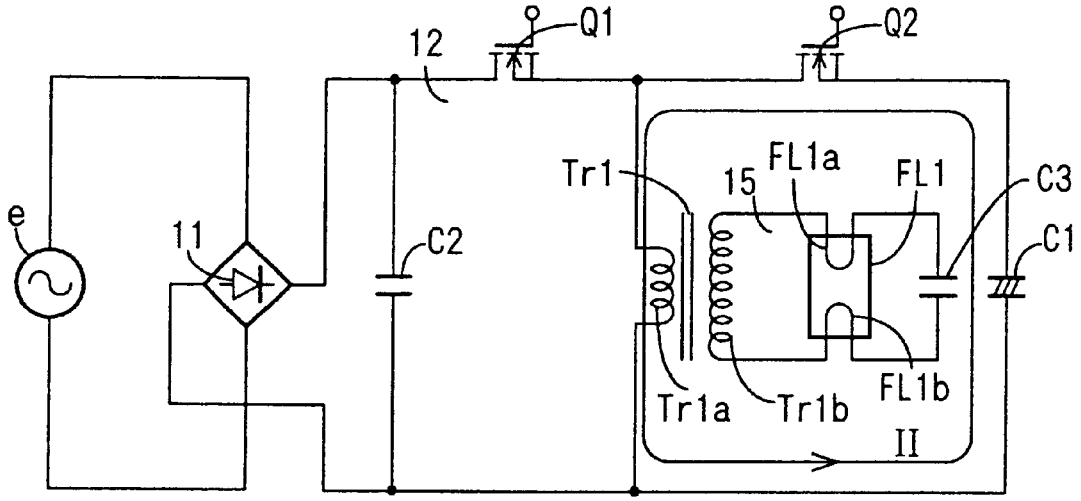
FIG. 4 is a circuit diagram showing the current in the step following the step shown in FIG. 3.

Then, in case where the first field-effect transistor Q1 is turned off while the second field-effect transistor Q2 remains off as shown in FIG. 4, the electromagnetic energy accumulated in the isolation leakage transformer Tr1 is discharged so that a decrease current flows in the closed circuit extending from the primary winding Tr1*a* of the isolation leakage transformer Tr1 through the smoothing condenser C1 to the parasitic diode of the second field-effect transistor Q2 an then back to the isolation leakage transformer Tr1, with the current value decreasing in this order. The smoothing condenser C1 is thus charged.

As a result, a negative terminal voltage Vo which is approximately equal to the value represented by the following equation 1 is generated at each end of the smoothing condenser C1. In the equation 1, the durations of the 'on' state and the 'off' state of the first field-effect transistor Q1 are respectively represented as $T_{ON}$ and $T_{OFF}$, and the non-smoothed DC voltage is represented as $V_P$.

$$Vo=-(T_{ON}/T_{OFF})V_p$$

The process described above represent the function as a polarity reversing active filter.

Figure 5:
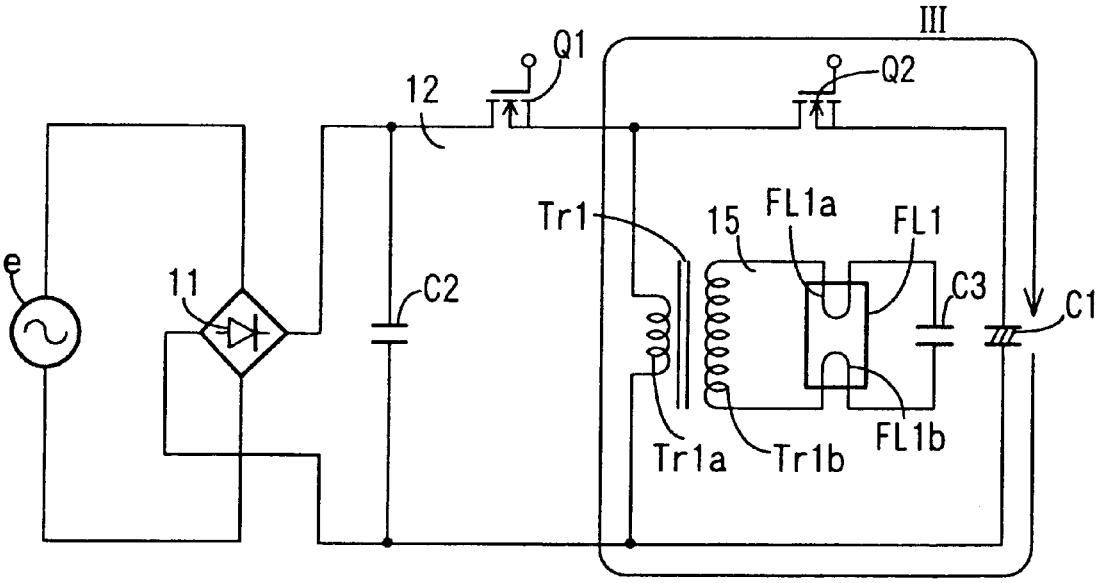
FIG. 5 is a circuit diagram showing the current in the step following the step shown in FIG. 4.

Next, when the second field-effect transistor Q2 and the first field-effect transistor Q1 are respectively in the 'on' state and 'off' state as shown in FIG. 5, the current flows in the closed circuit extending from the smoothing condenser C1 through the primary winding Tr1*a* of the isolation leakage transformer Tr1 to the second field-effect transistor Q2 and then back to the smoothing condenser C1, thereby accumulating electromagnetic energy in the isolation leakage transformer Tr1.

Figure 6:
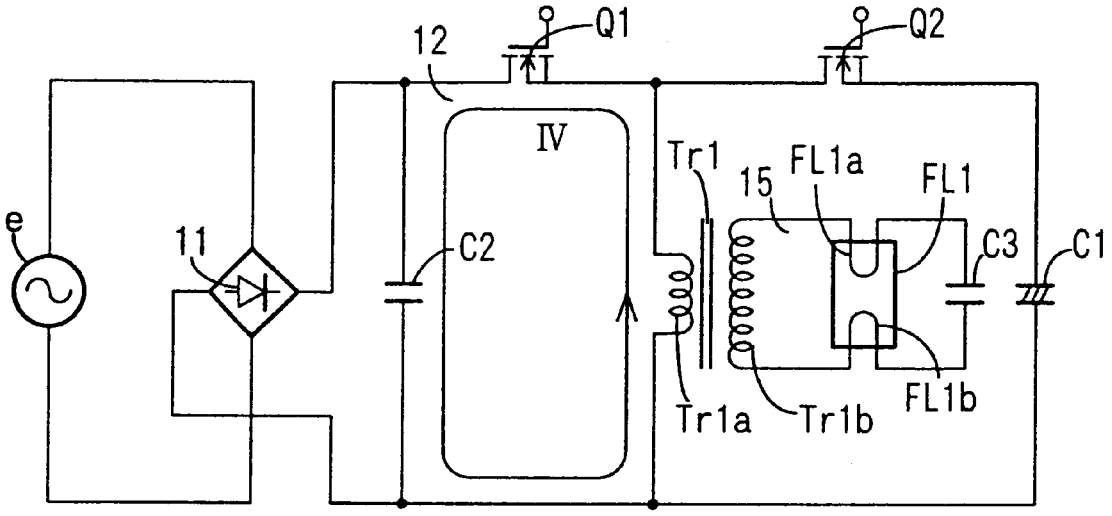
FIG. 6 is a circuit diagram showing the current in the step following the step shown in FIG. 5.

Then, when the second field-effect transistor Q2 is turned off while the first field-effect transistor Q1 remains off as shown in FIG. 6, the electromagnetic energy accumulated in the isolation leakage transformer Tr1 is discharged so that the current flows in the closed circuit extending from the primary winding Tr1*a* of the isolation leakage transformer Tr1 through the parasitic diode of the first field-effect transistor Q1 to the resonance condenser C2 and back to the primary winding Tr1*a* of the isolation leakage transformer Tr1, thereby charging the resonance condenser C2.

Figure 7:
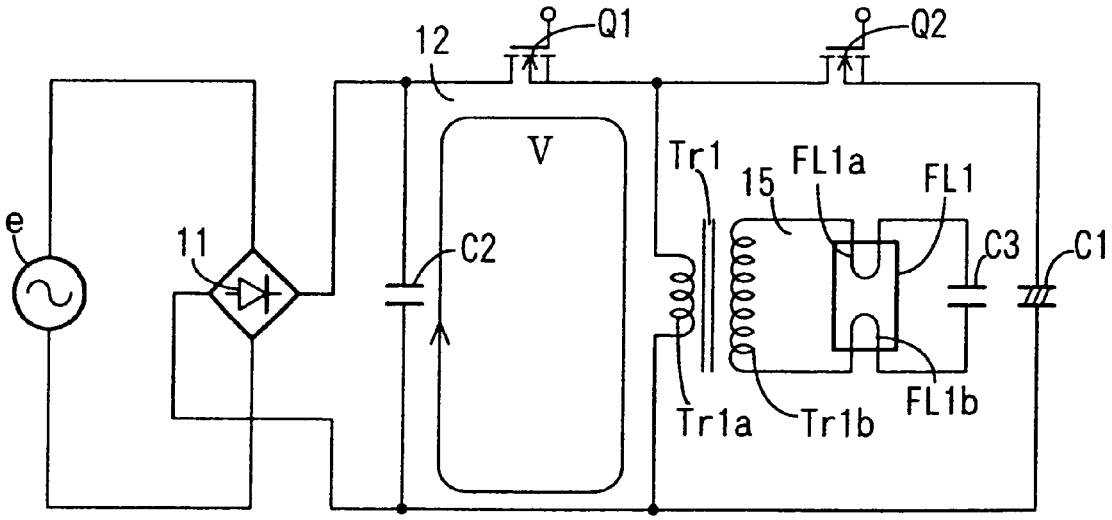
FIG. 7 is a circuit diagram showing the current in the step following the step shown in FIG. 6.
Figure 8:
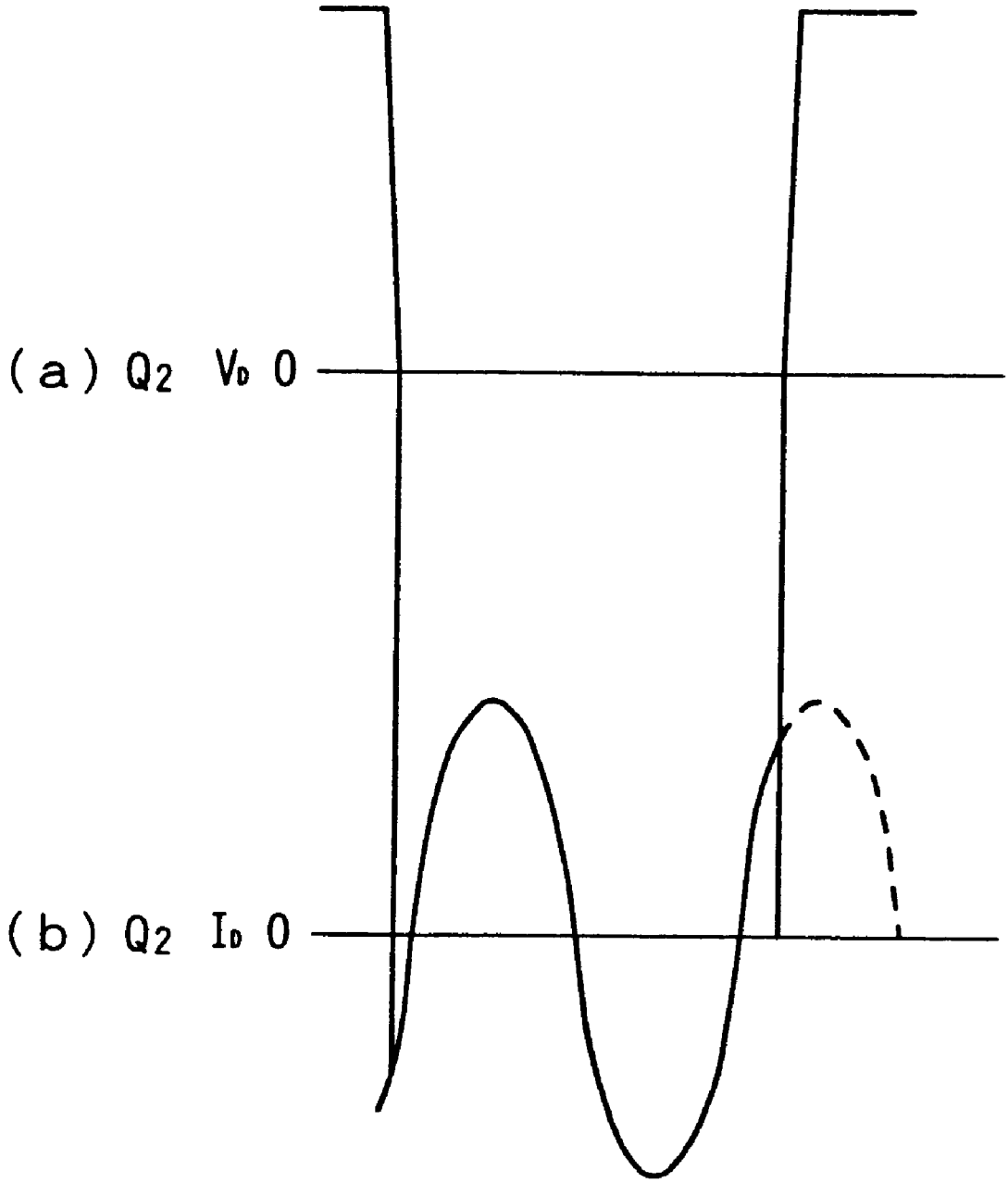
FIG. 8 is a waveform illustration showing the voltage on a second switching means of the first embodiment of a discharge lamp lighting device when the second switching means is in the 'on' state and the waveform of the current passing said second switching means when no load is applied or when the discharge lamp is not lit.

Next, when the first field-effect transistor Q1 and the second field-effect transistor Q2 are respectively in the 'on' state and 'off' state as shown in FIG. 7, the electric charge on the resonance condenser C2 is discharged so that the current flows in the closed circuit extending from the resonance condenser C2 through the second field-effect transistor Q2 to the primary winding Tr1*a* of the isolation leakage transformer Tr1 and back to the resonance condenser C2.

Thus, high frequency resonance between the isolation leakage transformer Tr1 and the resonance condenser C2 generates a high frequency AC voltage on both ends of the primary winding Tr1*a* of the isolation leakage transformer Tr1.

As a result, a high frequency voltage is induced on the secondary winding Tr1*b* of the isolation leakage transformer Tr1 by boosting, and leakage inductance generated on the secondary winding Tr1*b* of the isolation leakage transformer Tr1 acts as a current limiting impedance to energize the load circuit 15 with a high frequency so that the fluorescent lamp FL1 is started up and lit ina stabile condition. Thus, high frequency lighting of the fluorescent lamp FL1 is conducted. As a result, a low frequency AC current interrupted by high-frequency waves flows from the AC input terminal of the diode bridge 11. As the high-frequency waves are removed by the noise filters (not shown in the drawings), an AC input current having a low frequency which has a substantially sinusoidal waveform and nearly the same phase as that of the AC voltage flows from the commercial AC power source e into the combination-type high frequency inverter 12.

The process described above represent the function as an inverter.

As shown in FIG. 1, the first field-effect transistor Q1 serves as the switching means of the active filter so that the smoothing condenser C1 is charged with a voltage in proportion to the 'on' duration of the first field-effect transistor Q1.

Therefore, the 'on' duration of the first field-effect transistor Q1 is variable according to the present embodiment. In other words, by changing the 'on' duration of the first field-effect transistor Q1 in the manner of negative feed back with respect to the commercial AC power source e, the voltage charged on the smoothing condenser C1 can be stabilized, which results in the stable high frequency output voltage. If the 'on' duration of the first field-effect transistor Q1 is increased, the voltage charged on the smoothing condenser C1 is increased. When the 'on' duration of the first field-effect transistor Q1 is reduced, the voltage charged on the smoothing condenser C1, too, is reduced. The smoothing condenser C1 is adapted to be charged throughout virtually the entire period of each half cycle of the input AC voltage by means of the active filter function of the combination-type high frequency inverter 12. As there is no possibility of charging the smoothing condenser C1 directly with the non-smoothed rectified voltage from the diode bridge 11, the embodiment ensures a high input power factor and a sufficiently low harmonic-distortion characteristic regardless of the presence of the smoothing condenser C1.

The 'on' duration of the first field-effect transistor Q1 may automatically be changed as needed in accordance with instantaneous values of the non-smoothed voltage on the diode bridge 11, which is the voltage produced by rectifying the AC voltage from the commercial AC power source e. By thus adjusting the waveform, harmonic distortion can be reduced.

There are ways to compensate for fluctuation in the source voltage from the commercial AC power source e; for example, in case the voltage of the commercial AC power source e decreases, the 'on' duration of the first field-effect transistor Q1 may be increased while maintaining the 'on' duration of the second field-effect transistor Q2 constant so that the charge voltage on the smoothing condenser C1 is increased. As a result, a constant voltage is maintained on the smoothing condenser C1 in the manner of negative feed back. As the voltage on the smoothing condenser C1 is constant, the operating frequency is reduced, which results in increase in the lamp current of the fluorescent lamp FL1. Thus, reliable compensation for fluctuation in the source voltage from the commercial AC power source e is ensured. The voltage on the fluorescent lamp FL1 can also be changed by changing the 'on' duration of the second field-effect transistor Q2 while keeping the 'on' duration of the first field-effect transistor Q1 constant. However, changing the 'on' duration of the second field-effect transistor Q2 while keeping the 'on' duration of the first field-effect transistor Q1 constant presents a problem in compensating for fluctuation in the voltage of the commercial AC power source e; should the voltage on the smoothing condenser C1 be increased by reducing the 'on' duration of the second field-effect transistor Q2 in order to reduce the duration of discharge from the smoothing condenser C1,the operating frequency increases, which results in reduction of the voltage on the fluorescent lamp FL1. For this reason, changing the 'on' duration of the first field-effect transistor Q1 while keeping the 'on' duration of the second field-effect transistor Q2 constant is desirable as a method of compensating for fluctuation in the source voltage from the commercial AC power source e.

As the 'on' duration of the second field-effect transistor Q2 is limited in the range of 1 to 1.5 times the natural resonance cycle of the load circuit 15, the high frequency output voltage to be loaded, in other words there lease voltage, can be maintained at a desired value while conducting lagging switching. In short, desired load characteristics can be obtained by setting a constant duration of the 'on' state of the second field-effect transistor Q2. Setting the 'on' duration of the second field-effect transistor Q2 at a length of time where the range is 1 to 1.4 times the natural resonance cycle of the load circuit 15 is more appropriate to prevent phase-advancing switching of the second field-effect transistor Q2.

Furthermore, phase-advancing switching of the combination-type high frequency inverter 12 by satisfying the following mathematical expression, wherein the operating frequency of the combination-type high frequency inverter 12 during the period when the fluorescent lamp FL1 is in the lit state is represented as f, while the natural resonance frequency of the load circuit is represented as f0.

$$F0/3 \leqq f \leqq f0/2$$

When the operating frequency of the combination-type high frequency inverter 12 falls into the range of f0/2 to f0, the combination-type high frequency inverter 12 is put into a phase-advancing mode and becomes temporarily short-circuited. Such an occurrence must be prevented, because it may damage the second field-effect transistor Q2 and drastically impairs the reliability of the device.

The source and drain voltage of the second field-effect transistor Q2 at the time of switching the second field-effect transistor Q2, as well as the waveform of the drain current of the second field-effect transistor Q2 when no load is applied or when the lamp is not lit, are explained hereunder.

When the second field-effect transistor Q2 is in the 'off' state, the current is in the positive polarity, and the second field-effect transistor Q2 is in the state where it has been switched with lagged phases. The waveform of the current during the period when the fluorescent lamp FL1 is in the lit state is as follows: the current rises from the minus range when the second field-effect transistor Q2 is turned on; its value enters the plus range during the rising process; and while its value continues to increase, the current is shut off in the plus state when the second field-effect transistor Q2 is turned off.

Setting the operating frequency of the combination-type high frequency inverter 12 at a value close to the natural resonance frequency of the load circuit 15 accelerates start up of the fluorescent lamp FL1, because resonance produces a high release voltage, while the high operating frequency produces a great inductance in the load circuit 15, resulting in such load characteristics as a small amount of short-circuit current. Theoretically speaking, it does not matter whether the aforementioned frequency that is 'close to the natural resonance frequency of the load circuit 15' is greater or smaller than the natural resonance frequency of the load circuit 15. In actual practice, however, a frequency higher than the natural resonance frequency causes lagging switching and is therefore desirable. A frequency lower than the natural resonance frequency is not desirable, because it causes switching with advanced phases, which will exert an unfavorable influence on the switching means.

When the fluorescent lamp is in the lit state, resonance of the load circuit 15 will be, for all practical purposes, prevented by controlling the operating frequency of the combination-type high frequency inverter 12 to a level substantially lower than the natural resonance frequency of the load circuit 15. In such a case, the isolation leakage transformer Tr1 of the load circuit 15 functions merely as an impedance and reduces the release voltage of the combination-type high frequency inverter 12, thereby turning off a fluorescent lamp FL1 that is close to the end of its life or reducing its luminance. When a fluorescent lamp FL1 reaches the last stage of its life, its lamp voltage becomes considerably higher than that of a lamp in the normal condition. As it is described above, the release voltage is lower than the lamp voltage of a lamp at the end of its life. Therefore, if the operating frequency of the combination-type high frequency inverter 12 is set at, for example, a value in the range of approximately 2 to 2.7 times the lamp voltage of a lamp lit in the normal condition, a discharge lamp that is close to the end of its life is prevented from remaining lit.

The operating frequency of the combination-type high frequency inverter 12 of the fluorescent lamp FL1 that is in the lit state is controlled such that it is sufficiently lower than the natural resonance frequency of the load circuit 15. At that time, it does not matter whether the operating frequency is fixed or variable. In other words, the impedance of the load circuit 15 can be changed so as to dim the fluorescent lamp FL1 by changing the operating frequency continuously or intermittently, provided that the operating frequency is in such a range as to be sufficiently lower than the natural resonance frequency. Furthermore, the high release voltage increases the degree of possible dimming and therefore enables the deep dimming.

As described above, the embodiment described above has such load characteristics as a low release voltage and a relatively large amount of short-circuit current throughout the period when the fluorescent lamp FL1 is in the lit state. Such load characteristics can easily be obtained by appropriately setting the inductance and the capacitance of the load circuit 15 and the operating frequency of the combination-type high frequency inverter 12; for example, it is sufficient to set the capacitance of the condenser C3 which is connected in parallel with the fluorescent lamp FL1, to a value that is small enough to generate virtually no resonance during the period when the fluorescent lamp FL1 is in the lit state.

Thus, the embodiment described above prevents any disorder that might otherwise be caused by abnormal increase of temperature of the slender-type fluorescent lamp FL1 at the end of its life.

Each one of the first and second switching means of the embodiment explained above is a field-effect transistor of the MOS type, which is a voltage-driving unipolar transistor provided with a parasitic diode having a function similar to that of an antiparallely connected diode. However, the same effect can be obtained by using a current-driving bipolar transistor and connecting a diode in antiparallel with the bipolar transistor. It suffices that the member functioning as a diode whose normal polarity is the reverse of the direction of the normal polarity of the switching means is connected in parallel with the switching means.

Although the invention is explained as above, primarily referring to the embodiment wherein the 'on' duration of the second field-effect transistor Q2 is fixed, the 'on' duration of the first field-effect transistor Q1 may be fixed instead of the second field-effect transistor Q2. Furthermore, to fix the 'on' duration of the first field-effect transistor Q1 or the second field-effect transistor Q2 does not necessarily mean to constantly maintain a given, fixed duration; it is also permissible to set a variable 'on' duration by changing over the duration of the period of 'on' state according to the condition of the circuit so as to achieve a desired load operation. For example, the 'on' duration of the first field-effect transistor Q1 or the second field-effect transistor Q2 may be changed over between preset values, depending on whether the fluorescent lamp FL1 is in the process of starting up or in the lit state. Even if the fluorescent lamp is already in the lit state, the 'on' duration may be changed, depending on whether the fluorescent lamp FL1 is in the full-intensity illumination or in the dimming process. Furthermore, also during dimming, the 'on' duration may be changed according to the degree of dimming. Dimming of the fluorescent lamp FL1 maybe conducted by changing the duration of the on-duty of the second field-effect transistor Q2 of the combination-type high frequency inverter 12 independently or in sync with changes in the operating frequency.

It is recommended to provide a control means in the device in order to change over load characteristics in the manner described above, i.e. by changing over the operating frequency and, consequently, the output of the combination-type high frequency inverter 12 depending on whether the fluorescent lamp FL1 is in the process of starting up or in the lit state or by changing over the duration of the on-duty of the first field-effect transistor Q1 or the second field-effect transistor Q2, whichever is the one that is fixed. A control means may be provided also in order to change the 'on' duration during the period when the fluorescent lamp FL1 is in the lit state, depending on whether the fluorescent lamp FL1 is in the full-intensity illumination or in the dimming process. Furthermore, it does not matter whether dimming is conducted by stages or in a smooth, continuous manner. If it is necessary, the control means may also have the function of switching the control mode, which may include a light-off mode. As for the manner of operating the control means, a remote control that uses a wall switch or infrared ray or any other similar means may be employed.

Thus, the embodiment described above is capable of easily providing load characteristics that are optimal for the current mode in accordance with whether the fluorescent lamp FL1 is in the start-up mode or luminance mode. For example, when turning on a plurality of fluorescent lamps FL1, FL2 that are connected in parallel, the structure of the embodiment is capable of, without using a special protective circuit, such as a life-end detecting circuit, maintaining the normal fluorescent lamp FL1 (or FL2) in the lit state while reducing the luminance of the fluorescent lamp FL2 (or FL1) that is near the end of its life or entirely preventing it from being lit.

Although the invention is explained as above, referring to a case where slender-tube type discharge lamps, i.e. fluorescent lamps FL1, FL2 which are used exclusively for high frequency lighting and respectively identified by the product types of FHC27 and FHC34, are employed as discharge lamps for the invention, the invention is also applicable to lamps of other types that include, and not limited to, compact-type fluorescent lamps, compact self-ballasted fluorescent lamps, fluorescent lamps designed to be used exclusively for high frequency lighting, such as circular FHC20 lamps or straight-tube type FHF24 lamps, and other ordinary fluorescent lamps.

The number of load circuits 15 is not limited to one, and a plurality of load circuits 15 may be provided. If such is the case, the load circuits 15 should be connected in parallel with the combination-type high frequency inverter 12. There are no specific limitations in the structure of each load circuit, except that it includes a fluorescent lamp FL1, an inductance and a capacitance and that it has an natural resonance frequency. It is also permissible to provide a plurality of fluorescent lamps that are connected in series in the load circuit 15. The load circuit 15 is required to include a fluorescent lamp FL1 and a current limiting element that is adapted to limit the current from the combination-type high frequency inverter 12 so as to enable the stable lighting of the fluorescent lamp FL1. The load circuit 15 may also include a starting circuit adapted to start up the fluorescent lamp FL1. Leakage inductance of an isolation leakage transformer Tr1, which is usually used as a current limiting element for a fluorescent lamp, is used as the inductance for the embodiment described above. The combination-type high frequency inverter 12 and the inductance of the load circuit 15 may be used together with the leakage inductance of the isolation leakage transformer Tr1. The inductor is not limited to an isolation leakage transformer Tr1; any choke coil may serve for this purpose.

Although the condenser C3 for preheating the fluorescent lamp FL1 serves as the capacitance in the above embodiment, the capacitance may be comprised of a condenser that is used for interrupting a DC current or connected in series with the current limiting means so as to be used as a part of the current limiting means. As a condenser for interrupting a DC current usually has a great capacity, its influence on the natural resonance frequency can be ignored.

To function of an inverter, the combination-type high frequency inverter 12 may have any desired circuit system, including an inverter of such a type as a half-bridge or a full-bridge.

The resonance condenser C2 of the combination-type high frequency inverter 12 may be disposed at any location, provided that the location allows high frequency resonance between the resonance condenser C2 and the inductor; for example, the resonance condenser C2 may be connected to a point between the non-smoothing DC output terminals of the diode bridge 11, or connected in parallel with the first field-effect transistor Q1 or the second field-effect transistor Q2.

Figure 9:
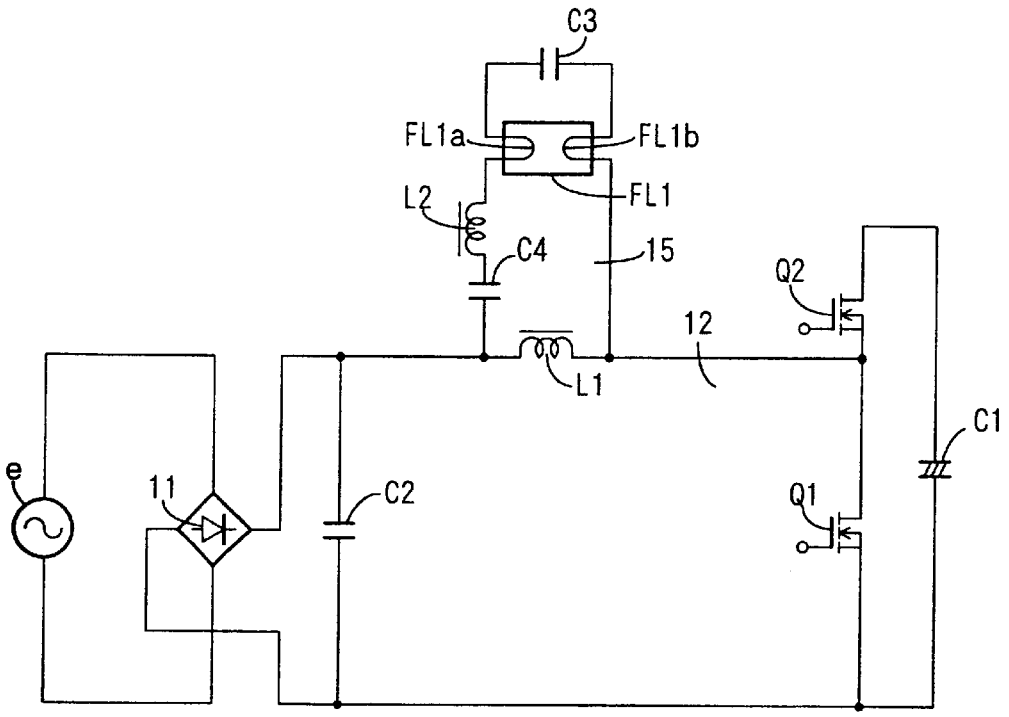
FIG. 9 is a circuit diagram of a second embodiment of a discharge lamp lighting device according to the invention.

Next, a discharge lamp lighting device according to the second embodiment of the invention is explained hereunder, referring to FIG. 9. The basic structure and function of the second embodiment are the same as those of the embodiment shown in FIG. 1, and any alternatives also have basically the same structure and function as those for the embodiment shown in FIG. 1.

FIG. 9 is a circuit diagram of a discharge lamp lighting device according to the second embodiment.

The second embodiment is different from the first embodiment in the structures of the combination-type high frequency inverter 12 and the load circuit 15.

The combination-type high frequency inverter 12 has a structure such that the portion functioning as an active filter is of a boosting type. An inductor L1 and a first field-effect transistor Q1 are arranged in series and connected to a point between non-smoothing DC output terminals of a diode bridge 11. A load circuit 15 is connected to both ends of the inductor L1. A series circuit consisting of a second field-effect transistor Q2 and a smoothing condenser C1 is connected to a point between both ends of the first field-effect transistor Q1.

The load circuit 15 is connected directly to the combination-type high frequency inverter 12. A DC interrupting condenser C4, a choke coil L2 and one end of each respective filament FL1*a*, FL1*b* of a fluorescent lamp FL1 are connected in series, and a condenser C3 is disposed between and connected to the other ends of the filaments FL1*a*, FL1*b* of the fluorescent lamp FL1. In case a plurality of fluorescent lamps FL1, FL2 are connected, a plurality of load circuits 15 should be connected in parallel.

Next, the function of the second embodiment described above is explained hereunder, referring to Table 2 and FIGS. 10 through 14.

TABLE 2

| | Field-effect Transistor Q1 | Field-effect Transistor Q2 |
|---|---|---|
| I (FIG. 10) | On | Off |
| II (FIG. 11) | Off | On (—) |
| III (FIG. 12) | Off | On |
| IV (FIG. 13) | On (—) | Off |
| V (FIG. 14) | On | Off |

Figure 10:
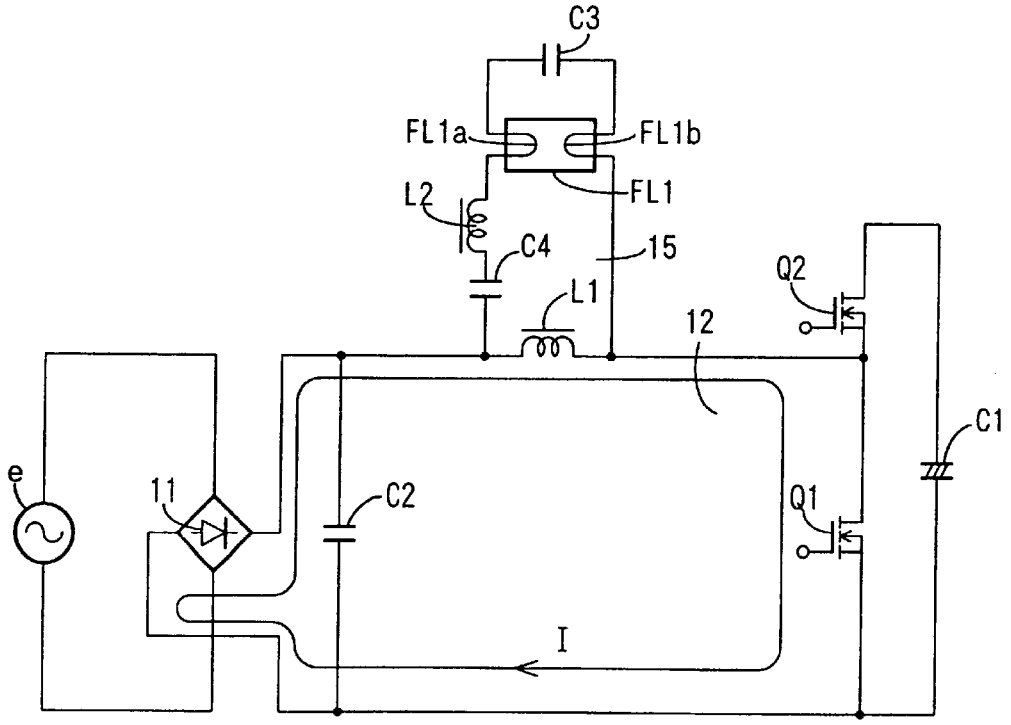
FIG. 10 is a circuit diagram showing the current in a step of the function of said second embodiment.

First, as shown in FIG. 10, when the first field-effect transistor Q1 is turned on while the second field-effect transistor Q2 is in the 'off' state, an increase current flows in the closed circuit extending from the positive electrode of the non-smoothing DC output terminals of the diode bridge 11 through the inductor L1 and the first field-effect transistor Q1 to the negative electrode of the diode bridge 11. As a result, electromagnetic energy accumulates in the inductor L1.

Figure 11:
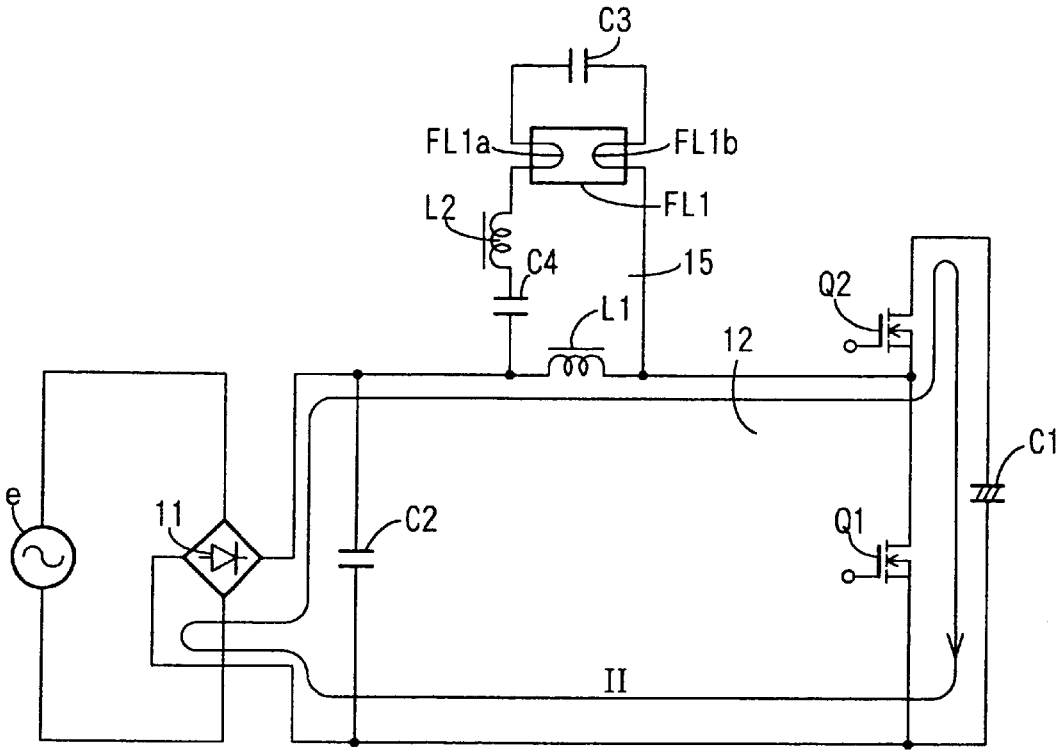
FIG. 11 is a circuit diagram showing the current in the step following the step shown in FIG. 10.

Then, as shown in FIG. 11, when the first field-effect transistor Q1 is turned off while the second field-effect transistor Q2 remains off, the electromagnetic energy is discharged from the inductor L1 so that a decrease current flows in the closed circuit extending from the inductor L1 through the parasitic diode of the second field-effect transistor Q2 and the smoothing condenser C1 to the resonance condenser C2 and back to the inductor L1, thereby charging the smoothing condenser C1.

As a result, a positive terminal voltage V0 represented by the following equation 2 is generated at each end of the smoothing condenser C1. In the equation 2, the durations of the 'on' state and the 'off' state of the first field-effect transistor Q1 are respectively represented as $T_{ON}$ and $T_{OFF}$, and the non-smoothed DC voltage on the diode bridge 11 is represented as $V_p$.

$$V0=\{(T_{ON}+T_{OFF})/T_{OFF}\}V_p$$

In other words, as the charged voltage V0 on the smoothing condenser C1 exceeds the non-smoothed DC voltage $V_p$ on the diode bridge 11, the component functioning as an active filter acts as a boosting type filter.

Figure 12:
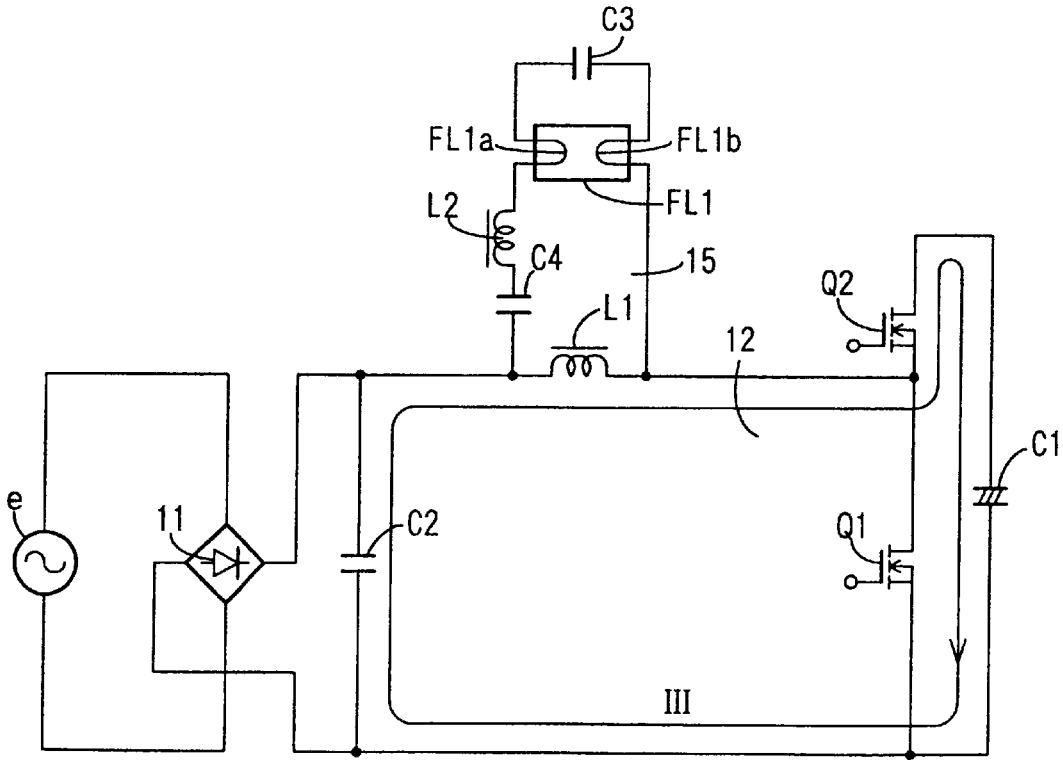
FIG. 12 is a circuit diagram showing the current in the step following the step shown in FIG. 11.

As shown in FIG. 12, when the second field-effect transistor Q2 and the first field-effect transistor Q1 are respectively in the 'on' state and 'off' state, the current flows in the closed circuit extending from the smoothing condenser C1 through the resonance circuit C2 and the inductor L1 to the second field-effect transistor Q2 and then back to the smoothing condenser C1. During this process, an increase current flows in the inductor L1 so that electromagnetic energy is accumulated in the inductor L1.

Figure 13:
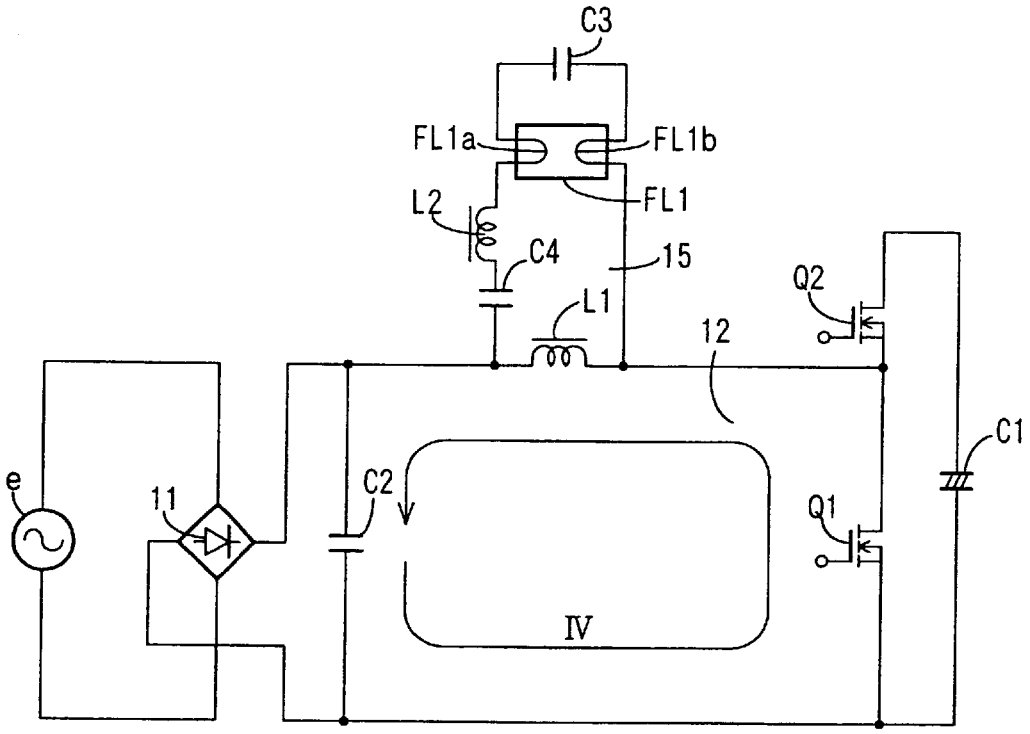
FIG. 13 is a circuit diagram showing the current in the step following the step shown in FIG. 12.

Next, as shown in FIG. 13, when the second field-effect transistor Q2 is turned off while the first field-effect transistor Q1 remains off, the electromagnetic energy is discharged from the inductor L1 so that a decrease current flows in the closed circuit extending from the inductor L1 through the resonance condenser C2 to the parasitic diode of the first field-effect transistor Q1 and back to the inductor L1, thereby charging the resonance condenser C2.

Figure 14:
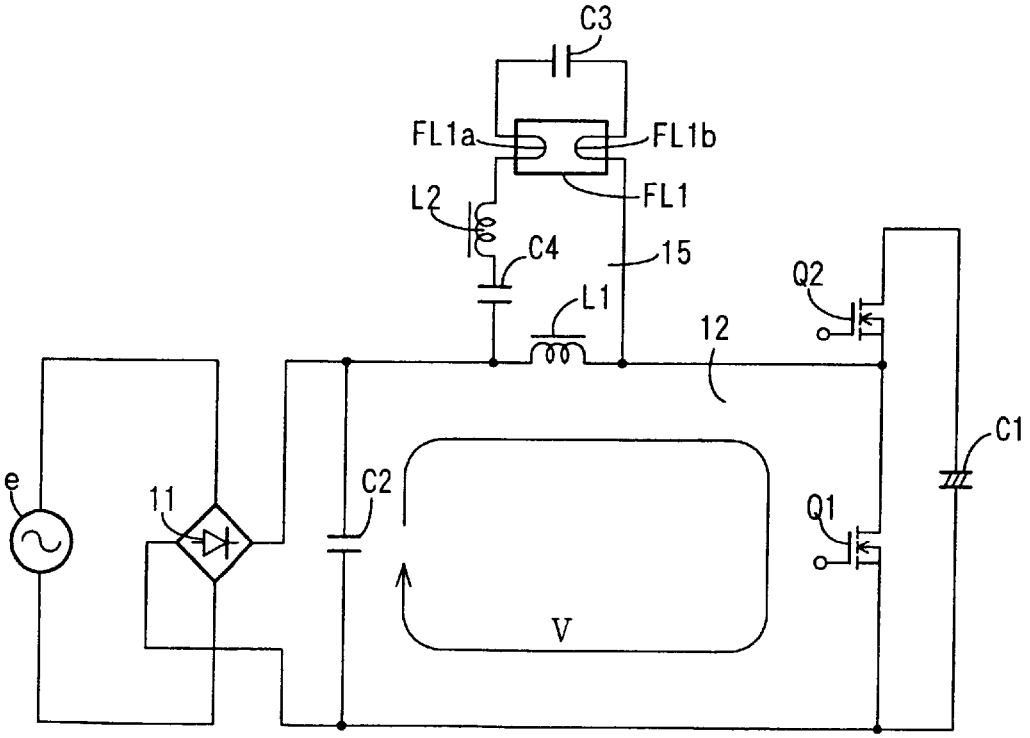
FIG. 14 is a circuit diagram showing the current in the step following the step shown in FIG. 13.

Then, as shown in FIG. 14, when the first field-effect transistor Q1 and the second field-effect transistor Q2 are respectively in the 'on' state and 'off' state, the electric charge on the resonance condenser C2 is discharged so that the current flows in the closed circuit extending from the resonance condenser C2 through the inductor L1 to the first field-effect transistor Q1 and back to the resonance condenser C2.

During the processes described above, high frequency resonance is generated between the inductor L1 and the resonance condenser C2.

As a result of operations of the circuits respectively functioning as an active filter and an inverter, a high frequency AC voltage appears on both ends of the inductor L1 so that the load circuit 15 operates with the inductor L1 serving as the power supply, thereby starting and lighting the fluorescent lamp FL1.

As the load circuit 15 is connected directly to the combination-type high frequency inverter 12, the DC interrupting condenser C4 prevents a DC component from flowing into the load circuit 15.

By setting the operating frequency at which the combination-type high frequency inverter 12 operates during starting up of the fluorescent lamp FL1 at a high level, it is made possible for series resonance between the choke coil L2 and the condenser C3 to apply a high voltage, which is necessary to start up the fluorescent lamp FL1, to a point between both ends of the fluorescent lamp FL1, ensuring the fluorescent lamp FL1 to be started and lit in a satisfactory condition. The operating frequency of the combination-type high frequency inverter 12 may be so arranged as to be reduced when starting up of the fluorescent lamp FL1 is completed and the fluorescent lamp FL1 is properly lit. By thus reducing the operating frequency of the combination-type high frequency inverter 12, series resonance between the choke coil L2 and the condenser C3 is minimized or almost entirely prevented, so that the release voltage is reduced.

Figure 15:
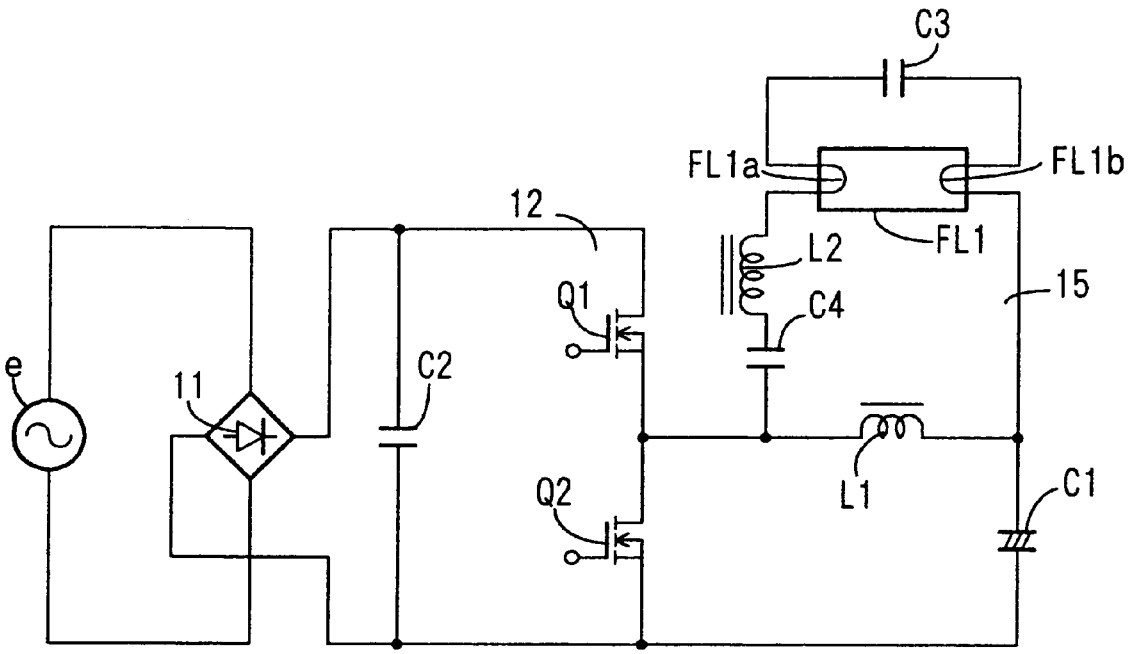
FIG. 15 is a circuit diagram of a third embodiment of a discharge lamp lighting device according to the invention.

Next, a discharge lamp lighting device according to the third embodiment of the invention is explained hereunder, referring to FIG. 15. The basic structure and function of the third embodiment are the same as those of the embodiment shown in FIG. 1, and any alternatives also have basically the same structure and function as those for the embodiment shown in FIG. 1.

FIG. 15 is a circuit diagram of a discharge lamp lighting device according to the third embodiment.

The third embodiment is different from the first embodiment in the structures of the combination-type high frequency inverter 12 and the load circuit 15.

The combination-type high frequency inverter 12 has a structure such that the portion functioning as an active filter is of a voltage reducing type. A first field-effect transistor Q1 and a second field-effect transistor Q2 are arranged in series and connected to a point between non-smoothing DC output terminals of a diode bridge 11. A series circuit consisting of an inductor L1 and a smoothing condenser C1 is connected to a point between both ends of the second field-effect transistor Q2. A load circuit 15 is connected to both ends of the inductor L1. In case a plurality of fluorescent lamps FL1, FL2 are connected, a plurality of load circuits 15 should be connected in parallel.

Next, the function of the third embodiment described above is explained hereunder, referring to Table 3 and FIGS. 16 through 20.

TABLE 3

| | Field-effect Transistor Q1 | Field-effect Transistor Q2 |
|---|---|---|
| I (FIG. 16) | On | Off |
| II (FIG. 17) | Off | On (—) |
| III (FIG. 18) | Off | On |
| IV (FIG. 19) | On (—) | Off |
| V (FIG. 20) | On | Off |

Figure 16:
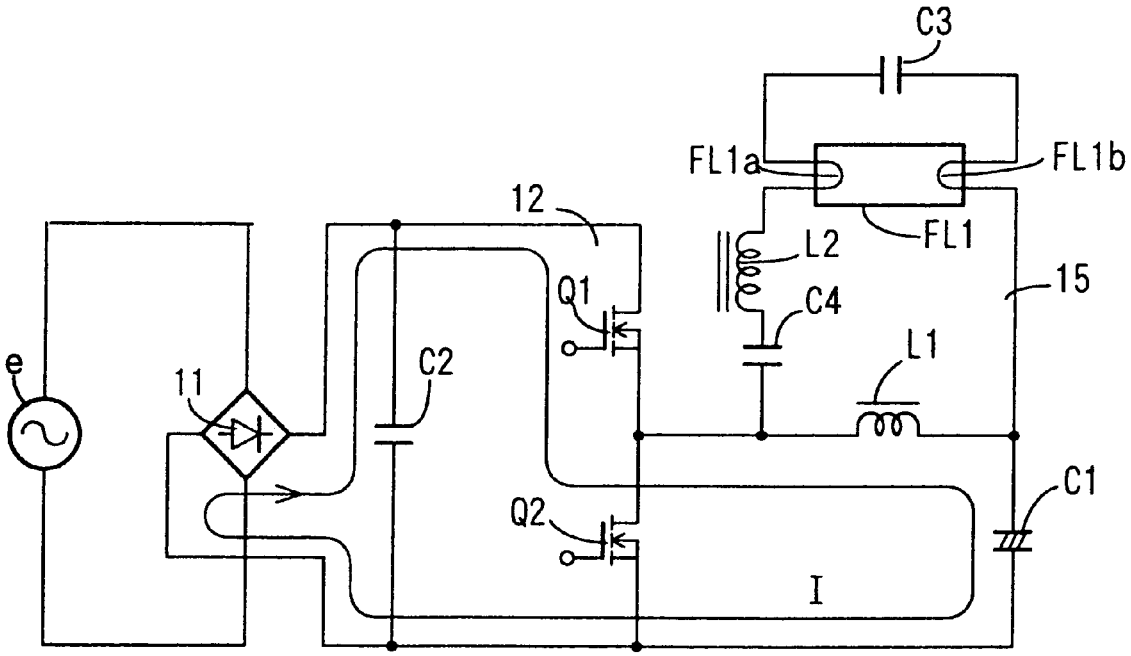
FIG. 16 is a circuit diagram showing the current in a step of the function of said third embodiment.

First, as shown in FIG. 16, when the first field-effect transistor Q1 is turned on while the second field-effect transistor Q2 is in the 'off' state, an increase current flows in the closed circuit extending from the positive electrode of the non-smoothing DC output terminals of the diode bridge 11 through the first field-effect transistor Q1, the inductor L1 and the smoothing condenser C1 to the negative electrode of the non-smoothing DC output terminals of the diode bridge 11. As a result, electromagnetic energy accumulates in the inductor L1.

Figure 17:
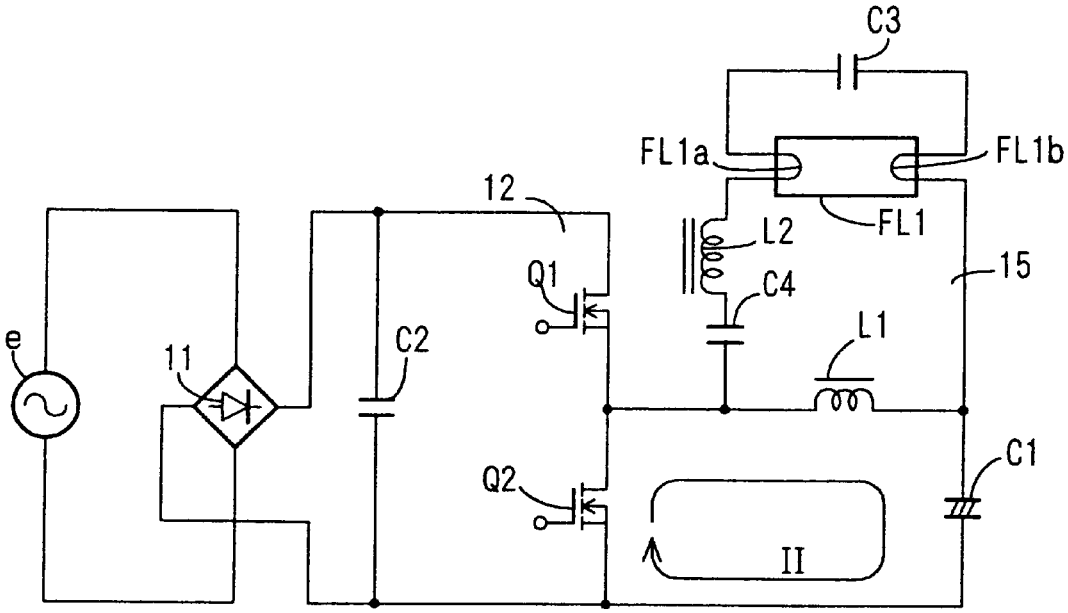
FIG. 17 is a circuit diagram showing the current in the step following the step shown in FIG. 16.

Then, as shown in FIG. 17, when the first field-effect transistor Q1 is turned off while the second field-effect transistor Q2 remains off, the electromagnetic energy accumulated in the inductor L1 is discharged so that a decrease current flows in the closed circuit extending from the inductor L1 through the smoothing condenser C1, the parasitic diode of the second field-effect transistor Q2 and the smoothing condenser to the inductor L1.

As a result, a positive terminal voltage V0 represented by the following equation 3 is generated at each end of the smoothing condenser C1. In the equation 3, the non-smoothed DC voltage on the diode bridge 11 is represented as $V_p$, and the durations of the 'on' state and the 'off' state of the first field-effect transistor Q1 are represented as $T_{ON}$ and $T_{OFF}$ respectively.

$$V0=\{T_{ON}/(T_{ON}+T_{OFF})\}V_p$$

In other words, voltage that has been reduced in proportion to the 'on' duration of the first field-effect transistor Q1 can be obtained.

Figure 18:
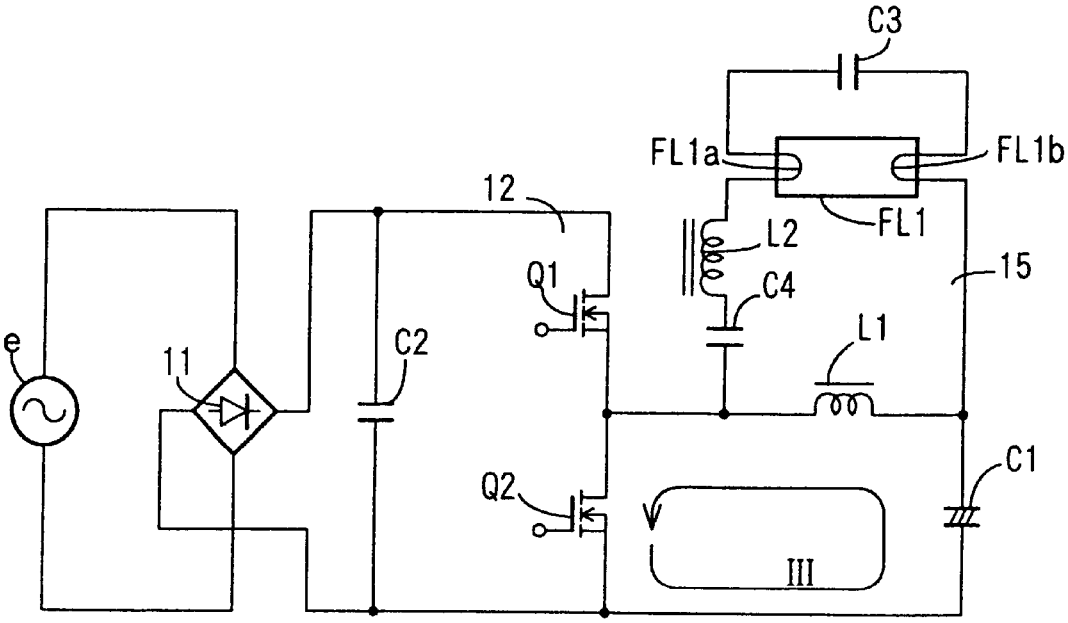
FIG. 18 is a circuit diagram showing the current in the step following the step shown in FIG. 17.

As shown in FIG. 18, when the second field-effect transistor Q2 and the first field-effect transistor Q1 are respectively in the 'on' state and 'off' state, the electric charge on the smoothing condenser C1 is discharged, and the current flows in the closed circuit extending from the smoothing condenser C1 through the inductor L1 to the second field-effect transistor Q2 and then back to the smoothing condenser C1. As a result, electromagnetic energy is accumulated in the inductor L1.

Figure 19:
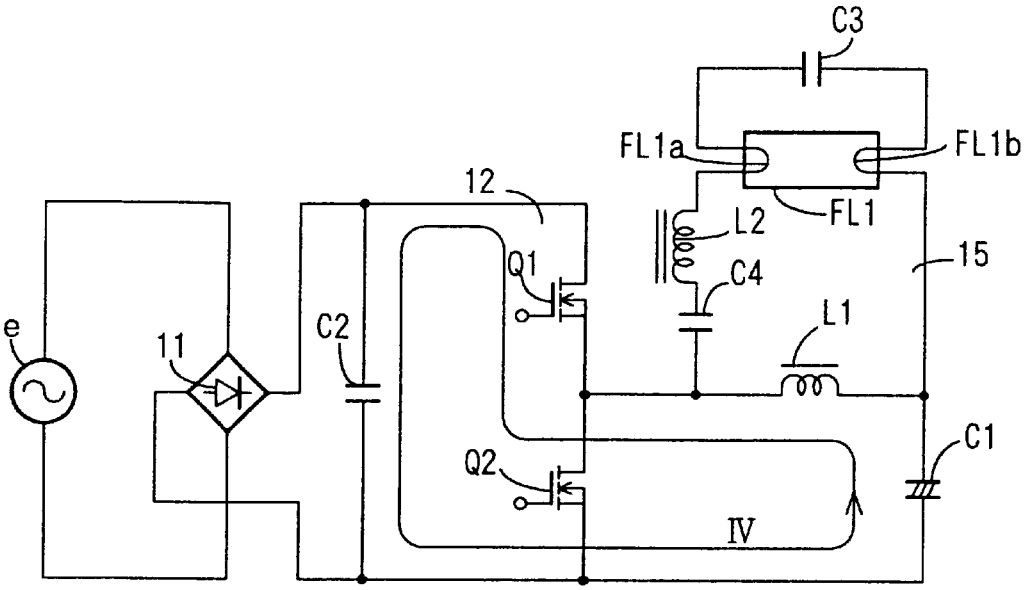
FIG. 19 is a circuit diagram showing the current in the step following the step shown in FIG. 18.
Figure 20:
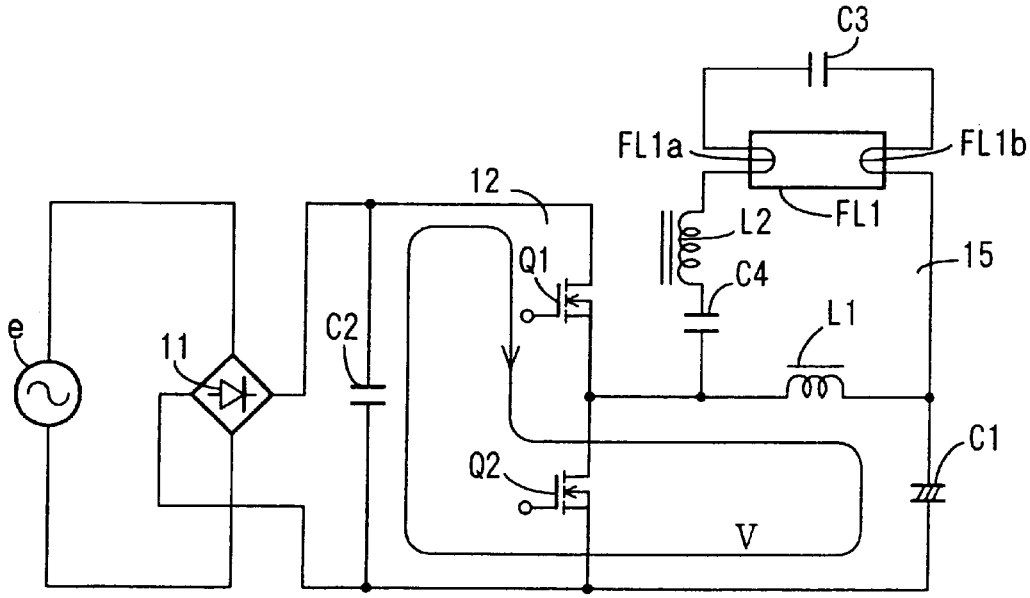
FIG. 20 is a circuit diagram showing the current in the step following the step shown in FIG. 19.

Next, as shown in FIG. 19, when the second field-effect transistor Q2 is turned off while the first field-effect transistor Q1 remains off, the electromagnetic energy on the inductor L1 is discharged so that a current flows in the closed circuit extending from the inductor L1 through the parasitic diode of the first field-effect transistor Q1 and the resonance condenser C2 to the smoothing condenser C1 and back to the inductor L1, thereby charging the resonance condenser C2.

Then, when the first field-effect transistor Q1 and the second field-effect transistor Q2 are respectively in the 'on' state and 'off' state, the electric charge on the resonance condenser C2 is discharged so that the current flows in the closed circuit extending from the resonance condenser C2 through the first field-effect transistor Q1 and the inductor L1 to the smoothing condenser C1 and back to the resonance condenser C2.

During the processes described above, high frequency resonance is generated between the inductor L1 and the resonance condenser C2 so that a high frequency AC voltage appears on both ends of the inductor L1. As the load circuit 15 thus operates at a high frequency with the inductor L1 serving as the power supply, the fluorescent lamp FL1 is started-up and becomes lit.

Figure 21:
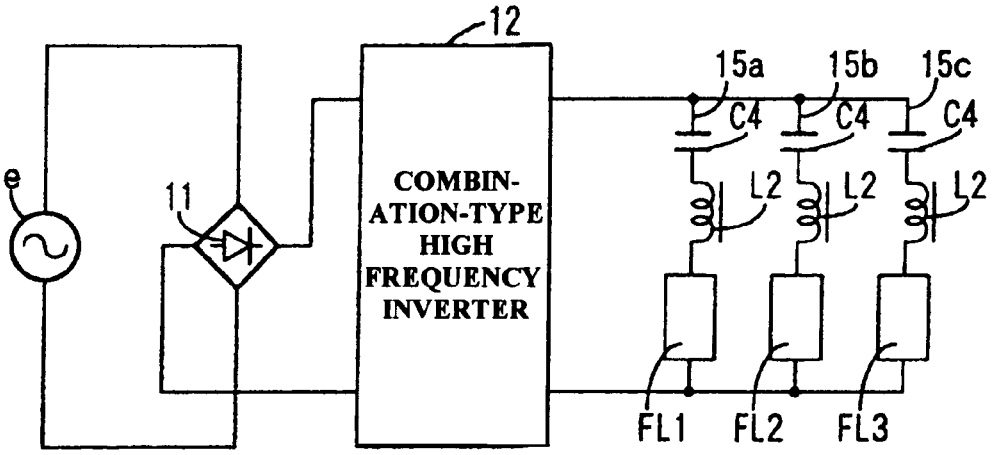
FIG. 21 is a circuit diagram of a fourth embodiment of a discharge lamp lighting device according to the invention.

Next, a discharge lamp lighting device according to the fourth embodiment of the invention is explained hereunder, referring to FIG. 21.

FIG. 21 is a circuit diagram of a discharge lamp lighting device according to the fourth embodiment.

The fourth embodiment has the same configuration as found in the first, second or third embodiment, provided that the fourth embodiment includes a plurality of load circuits 15 that are connected in parallel.

To be more specific, a plurality of load circuits 15*a,* 15*b,* 15*c* are arranged and connected in parallel with one another. Thus arranged load circuits 15*a,* 15*b,* 15*c* are disposed between and connected to the high-frequency output ends of a combination-type high frequency inverter 12.

Figure 22:
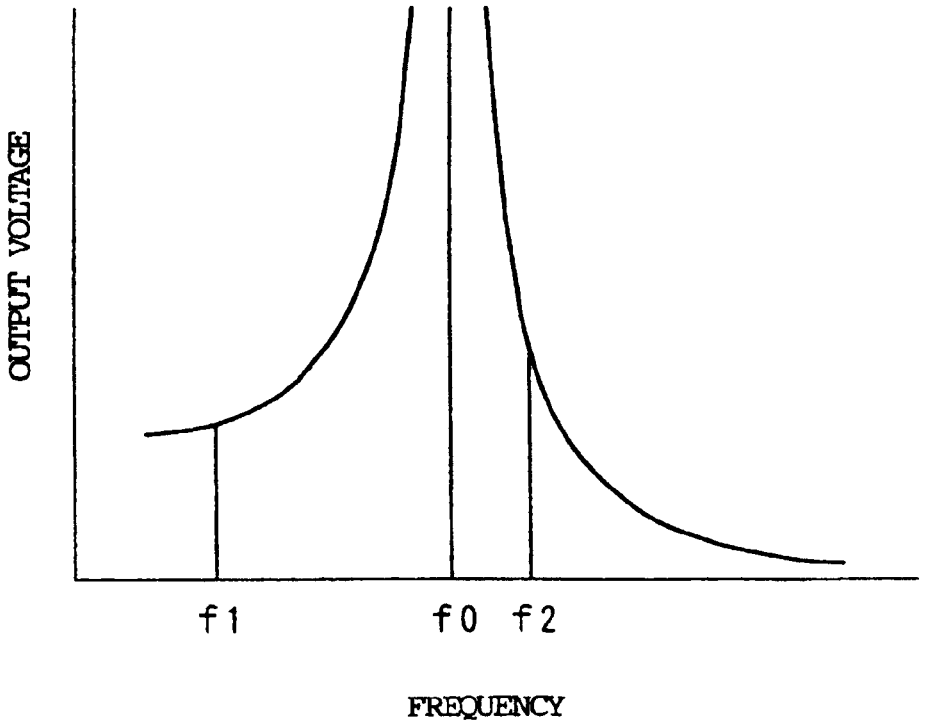
FIG. 22 is a graph representing frequency characteristics of the load circuits of said fourth embodiment of a discharge lamp lighting device.

As shown in FIG. 22, the combination-type high frequency inverter 12 is designed such that its operating frequency is changed over between different values depending on whether the lamp is being started up or completely on.

FIG. 22 shows frequency characteristics of the load circuits 15*a,* 15*b,* 15*c,* wherein the horizontal axis and the vertical axis respectively represent frequencies and output voltages. The operating frequencies of the combination-type high frequency inverter 12 are set such that the operating frequency f1 for the luminance mode and the operating frequency f2 for the start-upmode are respectively set at 50 KHz and 105 KHz, while the natural resonance frequency f0 of each load circuit 15*a,* 15*b,* 15*c* is set at 100 KHz.

Figure 23:
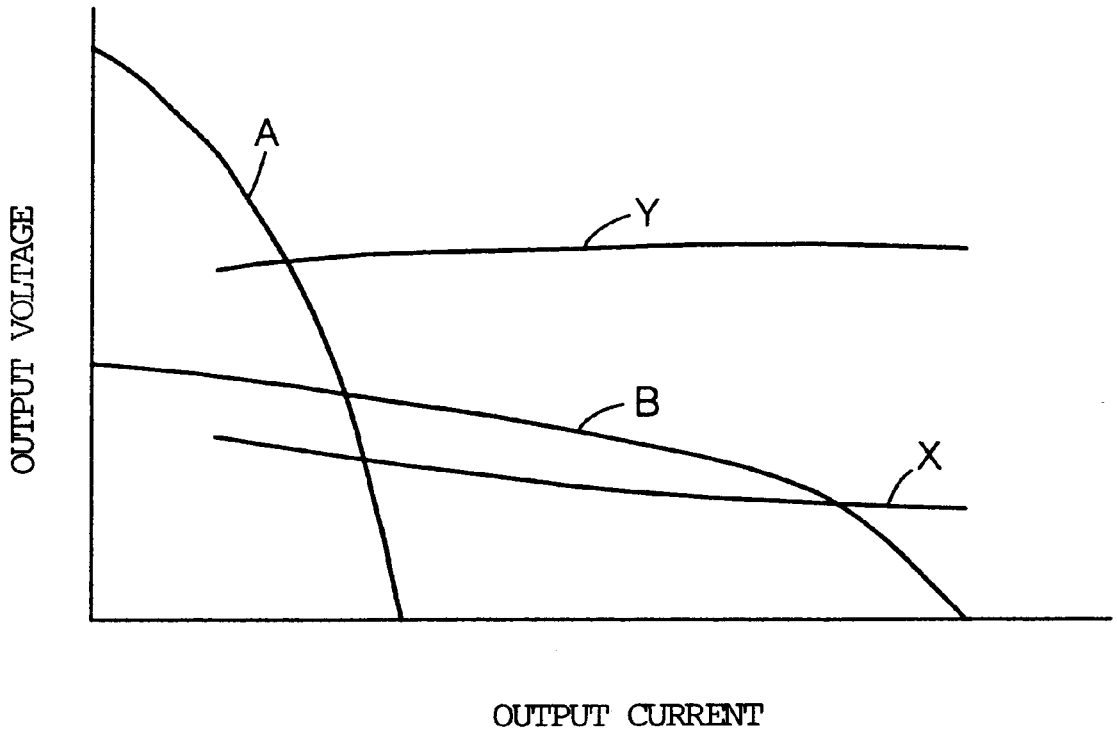
FIG. 23 is a graph representing load characteristics of a combination-type high frequency inverter and operating characteristics of a discharge lamp of said fourth embodiment.

Load characteristics of the combination-type high frequency inverter and the operating characteristics of the discharge lamps are shown in FIG. 23, wherein the horizontal axis and the vertical axis respectively represent output currents and output voltages. In the drawing, the load characteristics A and the load characteristics B respectively represent the load characteristics in the start-up mode and those in the luminance mode.

The load characteristics A for the start-up mode are so set as to have a high release voltage and a small amount of short-circuit current. Therefore, the on-duty period of the first field-effect transistor Q1 serving to charge the smoothing condenser C1 is set at a relatively great value.

The load characteristics B for the luminance mode, however, are so set as to have a low release voltage and a great amount of short-circuit current. Therefore, the on-duty period of the first field-effect transistor Q1 is set at a relatively small value.

As the operating characteristics (represented by the curve X in FIG. 23) of each fluorescent lamp FL1, FL2, FL3 functioning in the normal conditions are low enough to permit the curve X to intersect with the curve B that represents the load characteristics in the luminance mode, each fluorescent lamp FL1, FL2, FL3 is ensured to be lit in a stable condition.

Should a fluorescent lamp, e.g. the fluorescent lamp FL1 of the load circuit 15*a,* reach the last stage of its life, its operating characteristics (represented by the curve Y) become too high to intersect with the curve B, i.e. the load characteristics for the luminance mode. As a result, the fluorescent lamp FL1 is put out. However, as the other fluorescent lamps FL2, FL3 of the load circuits 15*b,* 15*c* are in the normal conditions, they remain lit in the stable condition.

Although the invention has heretofore been explained referring to the embodiments, wherein the combination-type high frequency inverter 12 has a function of an active filter that is of a polarity reversing, voltage boosting/reducing type, a voltage reducing type or a boosting type, the circuit system of the combination-type high frequency inverter 12 may be of any other type.

Examples of lighting systems to which the invention is applicable include, and not limited to, ordinary lighting fixtures or other luminaires which use, for some purpose, light emitted from a discharge lamp, image readers or various apparatuses incorporating image readers, e.g. office automation equipment, such as facsimiles, copy machines, scanners, etc., back light devices or various apparatuses incorporating back light devices, e.g. automobile instrument panels, Personal Digital Assistants, personal computers, wordprocessors, liquid crystal television picture receptors, GPS. As for lighting fixtures, the invention is applicable to a lighting fixture of any desired type, including those to be used in a household or other facilities, and it does not matter whether it is used indoors or outdoors. Furthermore, in case the invention is applied to a back light device, it does not matter whether it is of a sidelight type or a directly-underneath type.

Possible Industrial Application

The present invention is most suitable to be applied to a discharge lamp lighting device or a lighting device which call for turning off or reducing the light of a discharge lamp without using a special protective circuit when said discharge lamp comes to the end of its life.

What is claimed is:

1. A discharge lighting device comprising:

a load circuit provided with a discharge lamp, an inductance and a capacitance and having a natural resonance frequency, and a combination-type high frequency inverter which is provided with:

a full-wave rectifier for rectifying a low frequency AC voltage without smoothing the voltage;

at least a pair of switching means which have a function of an anti-parallel diode and are configured to be alternately switched, an inductor, a smoothing condenser, and a resonance condenser, said combination-type frequency inverter configured to operate with the duration of the 'on' state of one of the switching means variable and the 'on' duration of the other switching means fixed at a length of time where the range is 1 to 1.5 times the natural resonance cycle of the load circuit, and the combination-type high frequency inverter having a function of an active filter and serving to energize the load circuit with a high frequency output.

2. A discharge lamp lighting device as claimed in claim 1, wherein the operating frequency of the combination-type high frequency inverter is set such that the operating frequency for the period when the discharge lamp is in the start-up mode is close to the natural resonance frequency of the load circuit so as to obtain such load characteristics as a high release voltage and a small amount of short-circuit current, and that the operating frequency for the period when the discharge lamp is lit is sufficiently lower than the natural resonance frequency of the load circuit so as to obtain such load characteristics as a low release voltage and a great amount of short-circuit current.

3. A lighting system including:

a main body; and a discharge lamp lighting device as claimed in claim 1, which is supported by said body of lighting system.

4. A discharge lighting device comprising:

a load circuit provided with a discharge lamp, an inductance and a capacitance and having a natural resonance frequency; and a combination-type high frequency inverter which is provided with:

a full-wave rectifier for rectifying a low frequency AC voltage without smoothing the voltage;

a series circuit consisting of:

a first switching means that is connected to a point between DC output terminals of said full-wave rectifier and has a function of an antiparallel diode, and an inductor, a second switching means which has a function of an antiparallel diode and is configured to be switched alternately with the first switching means, and a smoothing condenser, and a resonance condenser configured to generate a high frequency resonance with the inductor, said combination-type high frequency inverter configured to operate with the duration of the 'on' state of either the first switching means or the second switching means variable and the 'on' duration of the other switching means fixed at a length of time where the range is 1 to 1.5 times the natural resonance cycle of the load circuit, and the combination-type high frequency inverter having a function of an active filter and serving to energize the load circuit with a high frequency output.

5. A discharge lamp lighting device as claimed in claim 4, wherein the operating frequency of the combination-type high frequency inverter is set such that the operating frequency for the period when the discharge lamp is in the start-up mode is close to the natural resonance frequency of the load circuit so as to obtain such load characteristics as a high release voltage and a small amount of short-circuit current, and that the operating frequency for the period when the discharge lamp is lit is sufficiently lower than the natural resonance frequency of the load circuit so as to obtain such load characteristics as a low release voltage and a great amount of short-circuit current.

6. A discharge lighting device comprising:

a load circuit provided with a discharge lamp, an inductance and a capacitance and having a natural resonance frequency; and a combination-type high frequency inverter which is provided with:

a full-wave rectifier for rectifying a low frequency AC voltage without smoothing the voltage;

a series circuit consisting of a first switching means and a second switching means that are connected to a point between DC output terminals of said full-wave rectifier and configured to be alternately switched so as to have a function of an antiparallel diode, and an inductor, a smoothing condenser, said inductor connected in parallel with said switching means, and a resonance condenser configured to generate a high frequency resonance with the inductor, said combination-type high frequency inverter configured to operate with the duration of the 'on' state of either the first switching means or the second switching means variable and the 'on' duration of the other switching means fixed at a length of time where the range is 1 to 1.5 times the natural resonance cycle of the load circuit, and the combination-type high frequency inverter having a function of an active filter and serving to energize the load circuit with a high frequency output.

7. A discharge lamp lighting device as claimed in claim 6, wherein the operating frequency of the combination-type high frequency inverter is set such that the operating frequency for the period when the discharge lamp is in the start-up mode is close to the natural resonance frequency of the load circuit so as to obtain such load characteristics as a high release voltage and a small amount of short-circuit current, and that the operating frequency for the period when the discharge lamp is lit is sufficiently lower than the natural resonance frequency of the load circuit so as to obtain such load characteristics as a low release voltage and a great amount of short-circuit current.

8. A discharge lighting device comprising:

a load circuit provided with a discharge lamp, an inductance and a capacitance and having a natural resonance frequency; and a combination-type high frequency inverter which is provided with:

a full-wave rectifier for rectifying a low frequency AC voltage without smoothing the voltage;

a series circuit consisting of:

an inductor connected to a point between DC output terminals of said full-wave rectifier, a first switching means having a function of an antiparallel diode, a second switching means which has a function of an antiparallel diode connected in parallel with the first switching means and is configured to be switched alternately with the first switching means; and a smoothing condenser, and a resonance condenser configured to generate high frequency resonance with the inductor, said combination-type high frequency inverter configured to operate with the duration of the 'on' state of either the first switching means or the second switching means variable and the 'on' duration of the other switching means fixed at a length of time where the range is 1 to 1.5 times the natural resonance cycle of the load circuit, and the combination-type high frequency inverter having a function of an active filter and serving to energize the load circuit with a high frequency output.

9. A discharge lamp lighting device as claimed in claim 8, wherein the operating frequency of the combination-type high frequency inverter is set such that the operating frequency for the period when the discharge lamp is in the start-up mode is close to the natural resonance frequency of the load circuit so as to obtain such load characteristics as a high release voltage and a small amount of short-circuit current, and that the operating frequency for the period when the discharge lamp is lit is sufficiently lower than the natural resonance frequency of the load circuit so as to obtain such load characteristics as a low release voltage and a great amount of short-circuit current.

10. A discharge lamp lighting device comprising:

a load circuit having a discharge lamp, an inductance and a capacitance; and a combination-type high frequency inverter which is provided with:

a full-wave rectifier for rectifying a low frequency AC voltage without smoothing the voltage, an inductor, a smoothing condenser, a resonance condenser, and at least a pair of switching means which have a function of an antiparallel diode and are configured to be alternately switched and respectively take part in charging the smoothing condenser and discharging from the smoothing condenser;

said combination-type high frequency inverter configured to operate in a manner that the 'on' duration of the switching means is configured to take part in charging the smoothing condenser is variable, while the 'on' duration of the switching means that is configured to take part in discharge from the smoothing condenser is fixed, and the combination-type high frequency inverter having a function of an active filter and serving to energize the load circuit with a high frequency output wherein:

the operating frequency of the combination-type high frequency inverter is set such that the operating frequency for the period when the discharge lamp is in the start-up mode is close to the natural resonance frequency of the load circuit so as to obtain such load characteristics as a high release voltage and a small amount of short-circuit current, and that the operating frequency for the period when the discharge lamp is lit is sufficiently lower than the natural resonance frequency of the load circuit so as to obtain such load characteristics as a low release voltage and a great amount of short-circuit current.

11. A lighting system including:

a main body; and a discharge lamp lighting device as claimed in claim 10, which is supported by said body of the lighting system.

12. A discharge lamp lighting device comprising:

a load circuit having a discharge lamp, an inductance and a capacitance; and a combination-type high frequency inverter which is provided with:

a full wave-rectifer for rectifying a low frequency AC voltage without smoothing the voltage, a series circuit consisting of:

a first switching means that is connected to a point between DC output terminals of said full-wave rectifier and has a function of an antiparallel diode, and an inductor, a second switching means which has a function of an antiparallel diode and is configured to be switched alternately with the first switching means, and a smoothing condenser, and a resonance condenser configured to generate high frequency resonance with the inductor, said combination-type high frequency inverter configured to operate in a manner that the 'on' duration of the first switching means is variable, while the 'on' duration of the second switching means is fixed, and the combination-type high frequency inverter having a function of an active filter and serving to energize the load circuit with a high frequency output, wherein:

the operating frequency of the combination-type high frequency inverter is set such that the operating frequency for the period when the discharge lamp is in the start-up mode is close to the natural resonance frequency of the load circuit so as to obtain such load characteristics as a high release voltage and a small amount of short-circuit currents and that the operating frequency for the period when the discharge lamp is lit is sufficiently lower than the natural resonance frequency of the load circuit so as to obtain such load characteristics as a low release voltage and a great amount of short-circuit current.

13. A lighting system including:

a main body; and a discharge lamp lighting device as claimed in claim 12, which is supported by said body of the lighting system.

14. A discharge lamp lighting device comprising:

a load circuit having a discharge lamp, an inductance and a capacitance; and a combination-type high frequency inverter which is provided with:

a full wave-rectifer for rectifying a low frequency AC voltage without smoothing the voltage, a series circuit consisting of a first switching means and a second switching means that are connected to a point between DC output terminals of said full-wave rectifier and are configured to be alternately switched so as to have a function of an antiparallel diode, an inductor, and a smoothing condenser, said inductor connected in parallel with the second switching means, and a resonance condenser configured to generate high frequency resonance with the inductor, said combination-type high frequency inverter configured to operate in a manner that the 'on' duration of the first switching means is variable, while the 'on' duration of the second switching means is fixed, and the combination-type high frequency inverter having a function of an active filter and serving to energize the load circuit with a high frequency output, wherein:

the operating frequency of the combination-type high frequency inverter is set such that the operating frequency for the period when the discharge lamp is in the start-up mode is close to the natural resonance frequency of the load circuit so as to obtain such load characteristics as a high release voltage and a small amount of short-circuit current. and that the operating frequency for the period when the discharge lamp is lit is sufficiently lower than the natural resonance frequency of the load circuit so as to obtain such load characteristics as a low release voltage and a great amount of short-circuit current.

15. A lighting system including:

a main body; and a discharge lamp lighting device as claimed in claim 14, which is supported by said body of the lighting system.

16. A discharge lamp lighting device comprising:

a load circuit having a discharge lamp, an inductance and a capacitance; and a combination-type high frequency inverter which is provided with:

a full wave-rectifer for rectifying a low frequency AC voltage without smoothing the voltage, a series circuit consisting of:

an inductor connected to a point between DC output terminals of said full-wave rectifier, and a first switching means having a function of an antiparallel diode, a second switching means which has a function of an antiparallel diode connected in parallel with the first switching means and is configured to be switched alternately with the first switching means, and a smoothing condenser, and a resonance condenser configured to generate high frequency resonance with the inductor, said combination-type high frequency inverter configured to operate in a manner that the 'on' duration of the first switching means is variable, while the 'on' duration of the second switching means is fixed, and the combination-type high frequency inverter having a function of an active filter and serving to energize the load circuit with a high frequency output, wherein:

the operating frequency of the combination-type high frequency inverter is set such that the operating frequency for the period when the discharge lamp is in the start-up mode is close to the natural resonance frequency of the load circuit so as to obtain such load characteristics as a high release voltage and a small amount of short-circuit current. and that the operating frequency for the period when the discharge lamp is lit is sufficiently lower than the natural resonance frequency of the load circuit so as to obtain such load characteristics as a low release voltage and a great amount of short-circuit current.

17. A lighting system including:

a main body; and a discharge lamp lighting device as claimed in claim 16, which is supported by said body of the lighting system.

* * * * *